US011718508B2

(12) United States Patent
Anzola et al.

(10) Patent No.: US 11,718,508 B2
(45) Date of Patent: Aug. 8, 2023

(54) LOAD ORIENTING DEVICE AND METHOD OF OPERATING SAME

(71) Applicant: Greenfield Products, LLC, Hazel Crest, IL (US)

(72) Inventors: Gustavo Anzola, Cumming, GA (US); Gary Hatton, Dickson, TN (US); Luis Sanchez, Cumming, GA (US)

(73) Assignee: GREENFIELD PRODUCTS, LLC, Hazel Crest, IL (US)

( * ) Notice: Subject to any disclaimer, the term of this patent is extended or adjusted under 35 U.S.C. 154(b) by 0 days.

(21) Appl. No.: 17/850,639

(22) Filed: Jun. 27, 2022

(65) Prior Publication Data

US 2022/0411235 A1 Dec. 29, 2022

Related U.S. Application Data

(60) Provisional application No. 63/215,670, filed on Jun. 28, 2021.

(51) Int. Cl.
*B66C 13/08* (2006.01)

(52) U.S. Cl.
CPC ..... *B66C 13/08* (2013.01)

(58) Field of Classification Search
CPC ..... B66C 13/08; B66C 13/085
See application file for complete search history.

(56) References Cited

U.S. PATENT DOCUMENTS 3,799,358 A * 4/1974 Putnam ..... B66C 13/08
5,898,746 A * 4/1999 Baversten ..... B66C 13/08
10,538,417 B1 * 1/2020 Raman ..... B66C 13/08
2004/0032140 A1 * 2/2004 Solstad ..... B66C 13/08
2020/0222257 A1 * 7/2020 Sikora ..... B66C 13/085

OTHER PUBLICATIONS

YouTube video clip entitled "Roborigger, an Automated Wireless Load Controlling System," uploaded on Jan. 16, 2019, by user "Tensa Equipment." [retrieved on Sep. 26, 2022]. Retrieved from Intenet: <https://www.youtube.com/watch?v=X6JWzPnxthw>. 5 pages.
YouTube video clip entitled "Verton EVEREST SpinPod 30," uploaded on Jun. 24, 2020, by user "Verton Australia." [retrieved on Sep. 26, 2022], Retrieved from Internet: <https://www.youtube.com/watch?v=9ZWcfc0b6-s>. 2 pages.
YouTube video clip entitled "Select Plant Hire Trials," uploaded on Dec. 17, 2020, by user "Torquer Lifting Solutions." [retrieved Sep. 26, 2022]. Retrieved from Internet: <https://www.youtube.com/watch?v=jet2zEzAayY>. 3 pages.
Richard, Craig. "Exclusive: Vestas deploys remotely operated blade-correcting installation tool," Wind Power Monthly, Nov. 24, 2020. [retrieved Sep. 26, 2022]. Retrieved from Internet <https://www.windpowermonthly.com/article/1700404/exclusive-vestas-deploys-remotely-operated-blade-correcting-installation-tool>. 6 pages.

* cited by examiner

*Primary Examiner* — Sang K Kim
*Assistant Examiner* — Nathaniel L Adams
(74) *Attorney, Agent, or Firm* — McCracken & Gillen LLC

(57) ABSTRACT

A load orienting device and method of operating the load orienting device are disclosed. The load orienting device includes a frame, first and second posts disposed on the frame, and first and second propellers disposed on the first and second posts, respectively. The first and second posts are movable to adjust a distance between the first and second propellers and a controller operates the first and second propellers to adjust an orientation of the load orienting device relative to a vertical axis of the load orienting device.

20 Claims, 23 Drawing Sheets

LOAD ORIENTING DEVICE AND METHOD OF OPERATING SAME

CROSS-REFRENCE TO RELATED APPLICATIONS

The present application claims benefit of priority to U.S. Provisional Patent Application Ser. No. 63/215,670, filed on Jun. 28, 2021, and entitled "LOAD ORIENTING DEVICE AND METHOD OF OPERATING SAME." The entire contents of this application are incorporated herein by reference.

FIELD OF DISCLOSURE

The present subject matter relates to a device and method for orienting a load, and more particularly, to a device and method for orienting a load suspended from a load moving device.

BACKGROUND

Cranes are used to move loads (e.g., containers, equipment, and the like) in a shipping port, a freight yard, a construction site, etc. from one location to another. For example, a load in a freight yard may be moved from a storage area onto a rail car or a truck trailer. Typically, a load line of a crane terminates in a hook. One or more cables may be secured to the load and such cables may be coupled to the hook. Thereafter, the crane to which such cables and, thus the load, are coupled may be operated to lift and move the load from an initial position to another position.

However, because the load is coupled to the crane via a single hook, the load may rotate or spin about the hook. Such spinning may be dangerous to personnel or other objects proximate the load as the load is moved between locations. Further, such spinning may make positioning the load in a particular orientation at the destination difficult and/or time consuming. Tag lines or ropes may be used to prevent spinning of the load, however such tag lines may be expensive to use and/or still be dangerous to personnel proximate the load. For example, when tag lines are used, personnel may need to be in proximity to a load suspended from the crane. Further, when a load is lifted too high in the air, the tag lines used are correspondingly long and may be challenging to control. Although the material cost of taglines may be inexpensive, using tag lines to stabilize a load may be quite expensive when the cost of the labor involved to manage such lines is accounted for.

Devices that rely on torque generated by spinning one or more gyroscopes and/or moving a large amount of mass have been developed rotate a load suspended from a crane to orient the load properly. However, these systems tend to be complex and require a significant amount of delay before during which the gyroscope or moving mass to attain enough speed to generate sufficient torque to control the orientation of the load.

SUMMARY

According to one aspect, a load orienting device includes a frame, first and second posts disposed on the frame, and first and second propellers disposed on the first and second posts, respectively. The first and second posts are movable to adjust a distance between the first and second propellers. The load orienting device also includes a controller that receives a command to rotate the load orienting device in a first direction and in response determines a direction in which the load orienting device is rotating, increases a rotation speed of the first and second propellers if the load orienting device is rotating in the first direction, and decreases the rotation speed of the first and second propellers otherwise.

According to another aspect, a method of operating a load orienting device, wherein the load orienting device includes a frame, first and second posts that are moveable and disposed on the frame, and first and second propellers disposed on the first and second posts, respectively, includes the steps of moving the first and second posts to adjust a distance between the first and second propellers, receiving a command to rotate the load orienting device in a first direction, and in response to the receiving step determining a direction in which the load orienting device is rotating. The method includes the additional step of, in response to determining step, increasing a rotation speed of the first and second propellers if the load orienting device is rotating in the first direction and decreasing the rotation speed of the first and second propellers otherwise.

Other aspects and advantages will become apparent upon consideration of the following detailed description and the attached drawings wherein like numerals designate like structures throughout the specification.

DETAILED DESCRIPTION

Figures 1, 1A:
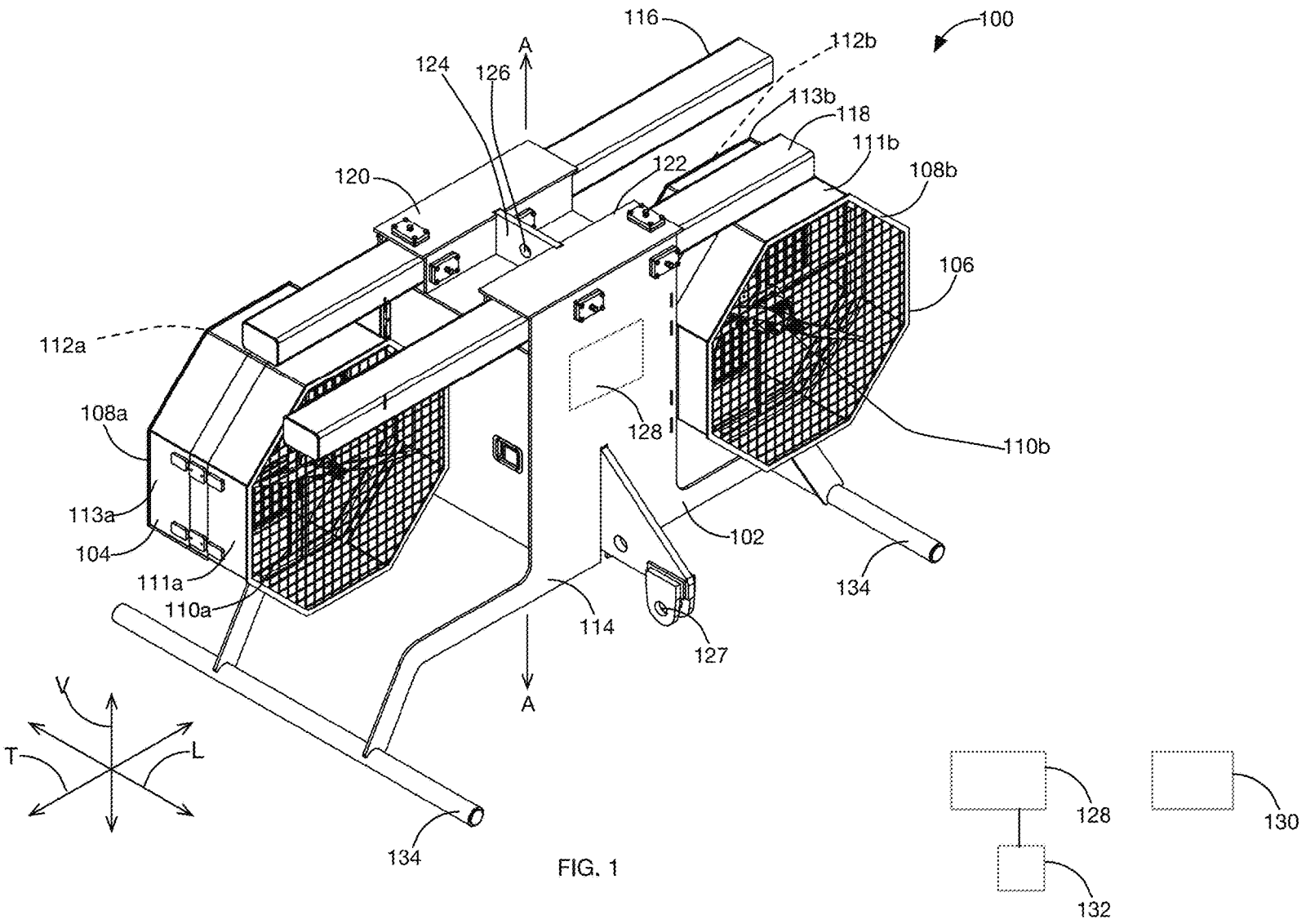
FIG. 1 is a front, top, and left-side isometric view of an embodiment of a load orienting device.
FIG. 1A is a block diagram of a controller and remote-control device of the load orienting device of FIG. 1.

Referring to FIGS. 1-4, a load orienting device 100 includes a frame 102 and a first fan module 104 and a second fan module 106 secured to the frame 102. In some embodiments, each fan module 104,106 comprises a fan housing 108. Disposed in the fan housing 108 are a first propeller 110 and a second propeller 112. In some embodiments, each propeller 110,112 comprises two blades. However, it should be apparent to one who has ordinary skill in the art that propellers comprising more than two blades may be used.

The propellers 110,112 rotate about an axis parallel to the longitudinal axis L of the load orienting device 100 and, when rotated, produce an air flow substantially parallel to such longitudinal axis. In addition, in some embodiments, the propellers 110*a* and 112*b* are operated to rotate to produce an airflow along a first direction and the propellers 110*b* and 112*a* are operated to rotate to produce an airflow along a second direction. The first and second directions are parallel to the longitudinal axis L and opposite relative to one another. Thus, for example, when viewed from a front side 114 of the load orienting device 100, the propellers 110*a* and 112*b* may be operated to produce an airflow toward the front side 114 of the load orienting device 100 and the propellers 110*b* and 112*a* may be operated to produce an airflow away from the front side 114. It should be apparent to one of ordinary skill in the art that the direction of thrust produced by the propellers 110,112 is opposite to the direction of the airflow produced by such propellers 110,112.

In some embodiments, the propellers 110*a*, 110*b*, 112*a*, and 112*b* are disposed in separate sub-housings 111*a*, 111*b*, 113*a*, and 113*b*, respectively. In such embodiments, the sub-housings 111*a* and 113*a* are joined to one another to form the fan housing 108*a* and the sub-housings 111*b* and 113*b* are joined to one another to form the fan housing 108*b*.

The first and second fan modules 104,106 are secured to first and second posts 116,118, respectively. The first and second posts 116,118 is held in first and second hollow tubular section 120,122, respectively, formed at the top of the frame 102. Disposed between the first and second tubular sections 120,122 is a plate 124 having a first opening 126 formed therein.

In addition, the frame 102 includes one or more second opening(s) 127 disposed proximate a bottom portion thereof. Cables or other attachment means (not shown) may be secured to such second opening(s) 127 and a load to be transported may be secured to such cables.

During use, a hook (not shown) attached to a cable of a crane (or another lifting device) may be passed through the first opening 126 to lift and transport the load orienting device 100, and thereby, any load coupled to the load orienting device 100 using cables secured to the second opening(s) 127.

The load orienting device 100 includes a controller 128 configured to operate the propellers 110*a*, 110*b*, 112*a*, and 112*b* independently of one another to generates thrust parallel to the longitudinal axis L of the load orienting device 100. In some embodiments, the controller 128 may be configured to detect that the load orienting device 100 (and any load attached thereto) is undergoing unwanted rotation (or is spinning) about a line A-A that passes through the first opening 126 and is parallel to a vertical axis V of the load orienting device 100. In response, the controller 128 operates the propellers 110,112 to generate thrust that counteracts such unwanted rotation. Such unwanted rotation may be caused by wind (or other environmental conditions) or because of movement of the load orienting device 100 and/or the load coupled thereto as the load is transported by the crane.

Referring also to FIG. 1A, the controller 128 may also be configured to be responsive to a remote-control device 130. An operator may use the remote-control device 130 to generate and send commands to the controller 128 to rotate the load orienting device 100 about the line A-A to change the orientation thereof and/or control the speed of rotation of the load orienting device 100. In response, the controller 128 operates the propellers 110,112 as described above to achieve such rotation.

In some embodiments, the operator may use the remote-control 130 to send a command to the controller 128 that specifies rotating the load orienting device 100 about the line A-A in a clockwise or counterclockwise direction to change the direction in which the longitudinal axis (and thus the front 114) of the load orienting device 100 points or to maintain (i.e., hold) the direction in which the longitudinal axis is pointing by countering any unwanted rotation of the load orienting device 100. In response, the controller 128 operates one or more of the propellers 110,112 of load orienting device 100 accordingly to change or maintain such direction.

In some embodiments, the controller 128 may be coupled to a direction sensing device 132 such as a compass or the like. In some embodiments, the operator may use the remote-control device 130 to specify a particular change in the angle in which the longitudinal axis L of the load orienting device 100 is pointing relative to a predetermined direction (e.g., magnetic North).

In response, the controller 128 uses the compass to automatically determine an initial direction of the longitudinal axis L of the load orienting device 100 relative to the predetermined direction, a final direction of the longitudinal axis L relative to the predetermined direction, and whether to rotate the load orienting device 100 in a clockwise or counterclockwise direction about the line A-A to change the direction of the longitudinal axis L from the initial direction to the final direction. Thereafter, the controller 128 automatically operates the one or more of propellers 110,112 to rotate the load orienting device 100 about the line A-A until the longitudinal axis L thereof points in the final direction. Further, the controller 128 may continue to operate the one or more propellers 110,112 to counteract any unwanted rotation of the load orienting device 100 about the line A-A to maintain the orientation of the load orienting device 100.

In some embodiments, the load orienting device 100 is battery powered. In some cases, the controller 128 may be configured to operate only one of the propellers 110,112 at a time to conserve battery power, for example, to extend battery life.

Some embodiments of the load orienting device 100 include one or more landing skid(s) 134 disposed at the bottom portion of the load orienting device 100. The landing skid(s) 134 support the load orienting device 100 when disposed on the ground or another surface.

Figure 2:
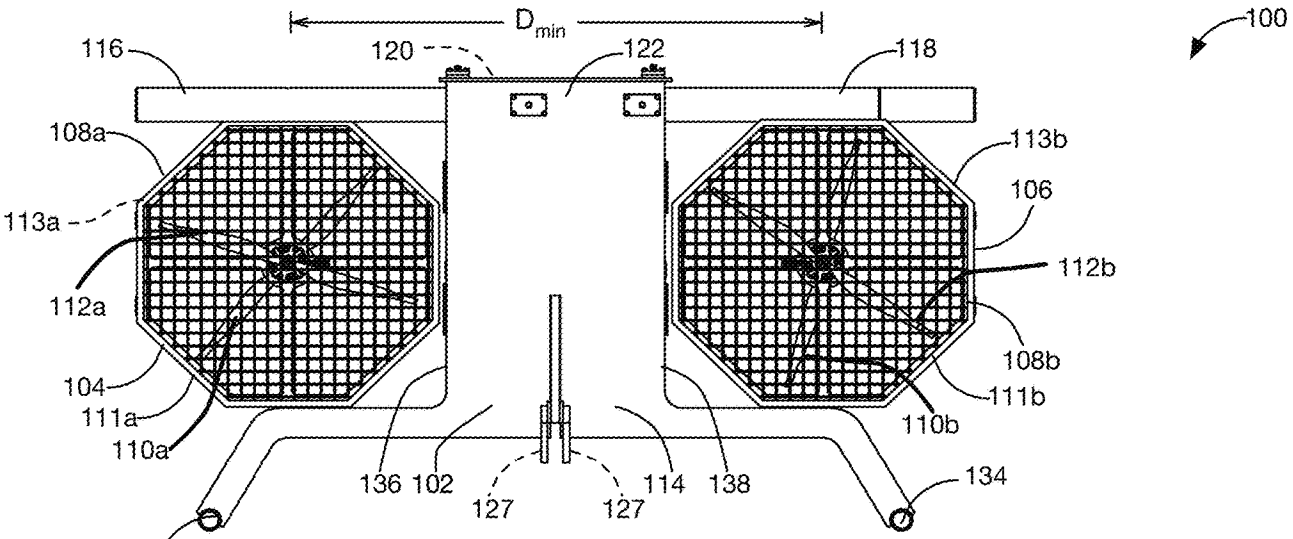
FIGS. 2 and 3 are front elevational views of the load orienting device of FIG. 1.

In some embodiments, the distance between the centers of the propellers 110 (and 112) that comprise the fan housings 108*a*,108*b* of the fan modules 104,106, respectively, may be adjustable to control the torque generated by the load orienting device 100 about the vertical axis thereof. In particular, the posts 116,118 may be inserted into the first and second tubular sections 120,122, respectively, to decrease the distance between the centers of the propellers 110*a*,110*b* (and 112*a*,112*b*) of the first and second fan modules 104,106, respectively, along the transverse axis T, as shown in FIG. 2, to a predetermined minimum distance $D_{min}$. In some embodiments, when the center-to-center distance between the propellers 110*a* and 110*b* (and 112*a* and 112*b*) is $D_{min}$, the fan modules 104,106 may be adjacent to or abut sidewalls 136,138, respectively, of the frame 102.

Figure 3:
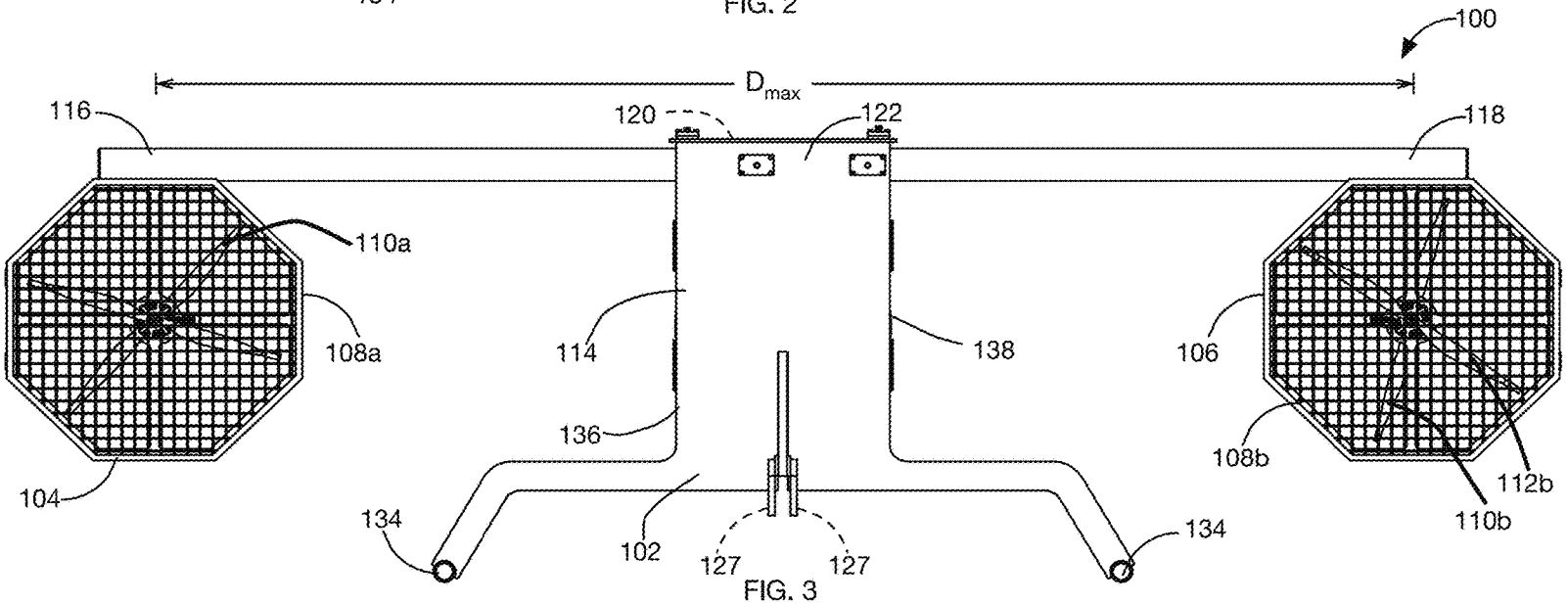
Figure 4:
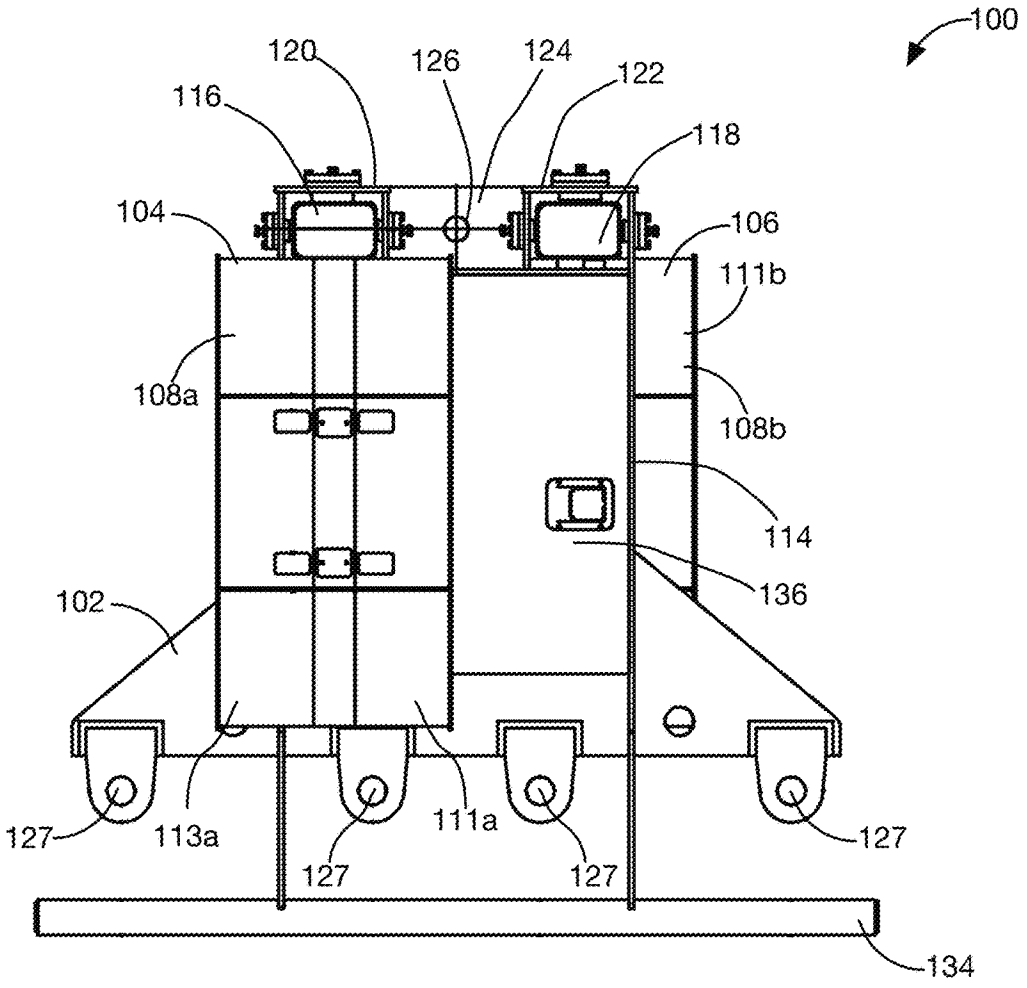
FIG. 4 is a left-side elevational view of the load orienting device of FIG. 1.

Similarly, the first and second posts 116,118 may be retracted outwardly from the first and second tubular sections 120,122, respectively, to increase the distance between the centers of the propellers 110*a*,110*b* (and 112*a*,112*b*) of the fan module 104,106, respectively, along the transverse axis T, as shown in FIG. 3 to a maximum distance $D_{max}$. It should be apparent to one who has ordinary skill in the art that the positions of the fan modules 104,106 may be adjusted so that the center-to-center distance between the propellers 110*a* and 110*b* is between $D_{min}$ and $D_{max}$, inclusive. In some embodiments, the lengths of the first and second posts 116,118 are such that the center-to-center distance between the propellers 110*a* and 110*b* may be adjustable between a $D_{min}$ of approximately 5 feet and a $D_{max}$ of approximately 12 feet. It should be apparent to one who has skill in the art that the center-to-center distances $D_{min}$ and $D_{max}$ and may be configured by using first and second posts 116,118 having different lengths and/or fan housings 104,106 of different sizes.

In some embodiments, the speed at which the propellers 110,112 may be operated is variable and the controller 128 adjusts the speed of the propellers 110,112 as necessary to produce a desired amount of thrust to change the orientation of the load orienting device 100. For example, the controller 128 may adjust the speed of the propellers 110,112 in accordance with an amount the orientation of the load orienting device 100 is to be changed. In other cases, the operator may direct the controller 128 to increase or reduce the speed of the propellers 110,112 using the remote-control device 130 to adjust the rotational speed of the load orienting device 100.

In other embodiment, such speed if fixed and the controller 128 selectively turns the propellers 110,112 on and off as necessary to change the orientation and/or rotational speed of the load orienting device 100.

In some embodiments, the distances $D_{min}$ and $D_{max}$ are selected such that torque produced by operating the fan modules 104,106 when positioned at a distance $D_{max}$ apart is approximately twice the torque produced when the fan modules 104,106 are position at a distance $D_{min}$ apart.

In some embodiments, after the first and second posts 116,118 are extended or retracted within the tubular sections 120,122, respectively, to position the fan modules 104,106 as described above, one or more securing device(s) (not shown) may be used to secure the posts 116,118 and the tubular sections 120,122, respectively. Such securing device (s) may include, for example, a pin (e.g., a clevis pin, a spring load pin, a cotter pin, and the like), a screw, a bolt, or any other fastener apparent to one of ordinary skill in the art.

Although the embodiment of the load orienting device 100 shown in FIGS. 1-4 illustrates fan housings 108 that are substantially octagonal, it should be apparent to one who has ordinary skill in the art that the housings 108 may be of different shapes. Referring to FIGS. 5-8, a load orienting device 150 is substantially identical to the load orienting device 100 (FIGS. 1-4) except the fan housings 108 are substantially semi-elliptical. Further, the load orienting device 150 includes a single tubular section 152 in which the first and second posts 116,118 are disposed, first and second electrical chains 154,156 coupled to the first and second posts 116,118, respectively, and one or more monitor(s) 158 disposed on one or more respective outward facing wall(s) 160 of the tubular section 152. The electrical chains 154,156 may be used to guide electrical cables from a battery (or other power supply) to motors (not shown) that drive the propellers 110,112, to the monitor 128, and/or between other components of the load orienting device 150.

Each monitor 158 includes one or more display device(s) 162. In some embodiments, the display device(s) 162 are light emitters such as an LED or an incandescent bulb. The controller 128 actuates the display device(s) 162 to indicate a status of the load orienting device 150. For example, the display devices 162 may include a green-light emitter 162*a* and a red-light emitter 162*b*. The controller 128 may actuate the green-light emitter 162*a* to indicate that the load orienting device 150 has been turned on. Further, the controller 128 may cause the red-light emitter 162*b* to flash if electrical capacity of a power supply, e.g., a battery pack (not shown), of the load orienting device 150 is below a predetermined amount. In addition, the controller 128 may actuate the red-light emitter 162*b* to emit a solid (i.e., not flashing) red-light if a fault is detected. It should be apparent that the controller 128 may actuate the green-light and red-light emitters 162 in different flashing patterns to indicate different faults or operating conditions that correspond to such patterns.

It should be apparent to one who has ordinary skill in the art that the red-light and green-light emitters 162 may be replaced by a screen display (e.g., an LCD screen) or another a type of visual device. Further, it should be apparent that the monitor 158 may include a sound emitter (not shown) operable by the controller 130 that emits sounds associated with different modes of operation of the load orienting device 150 such as, for example, start-up, fault, shut down, and the like.

In some embodiments, instead of having the plate 124 between the first and second tubular sections 120,122 (see FIGS. 1-4), the load orienting device 150 may include a plate 164 disposed atop the single tubular section 152. One or more loops 166 formed, for example, from cabling or another strong, flexible material may be secured to the plate 164 and the crane hook (not shown) may be passed through such loops 166 to facilitate lifting and transport of the load orienting device 150 (and thereby the load secured thereto).

It should be apparent to one who has ordinary skill in the art that the monitor 158 described and loops 166 disclosed in connection with the load orienting device 150 may be adapted for use with the other embodiments of the load orienting devices (e.g., the load orienting device 100) and kit (described below) disclosed herein.

Figure 9:
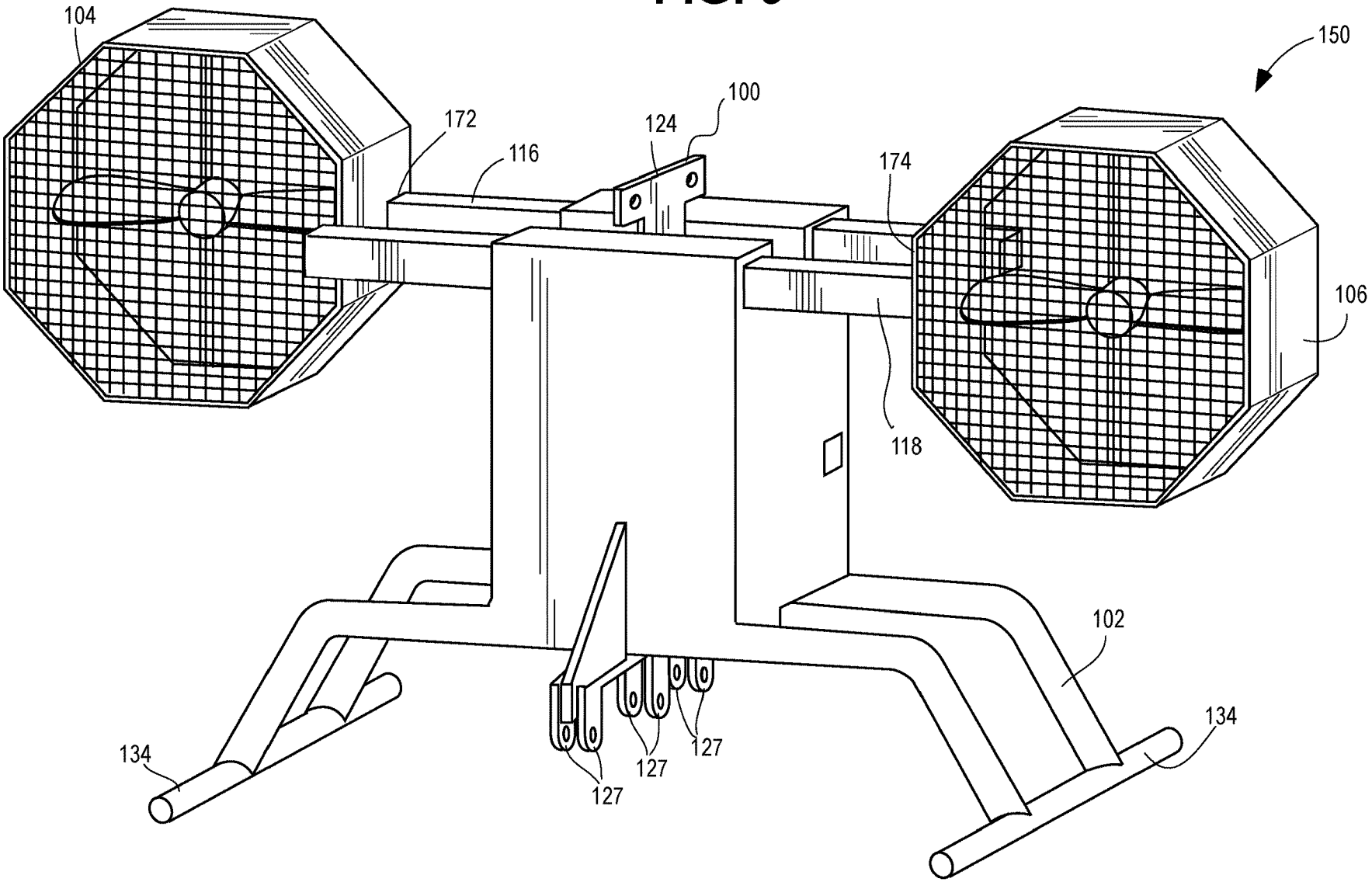
FIG. 9 is a front, top, right-side isometric view of yet another embodiment of a load orienting device.

Although the embodiments shown in FIGS. 1-8 show load orienting devices 100,150 having first and second fan modules 104,106 secured to an underside of the first and second posts 116,118, respectively, it should be apparent to one who has ordinary skill in the art that the first and second fan modules 104,106 may be secured to other portions of the first and second posts 116,118, respectively. For example, FIG. 9 shows a load orienting device 170 that is substantially identical to that shown in FIGS. 1-4 except the fan modules 104,106 are mounted at distal ends 172,174 of the first and second posts 116,118, respectively.

Figure 10:
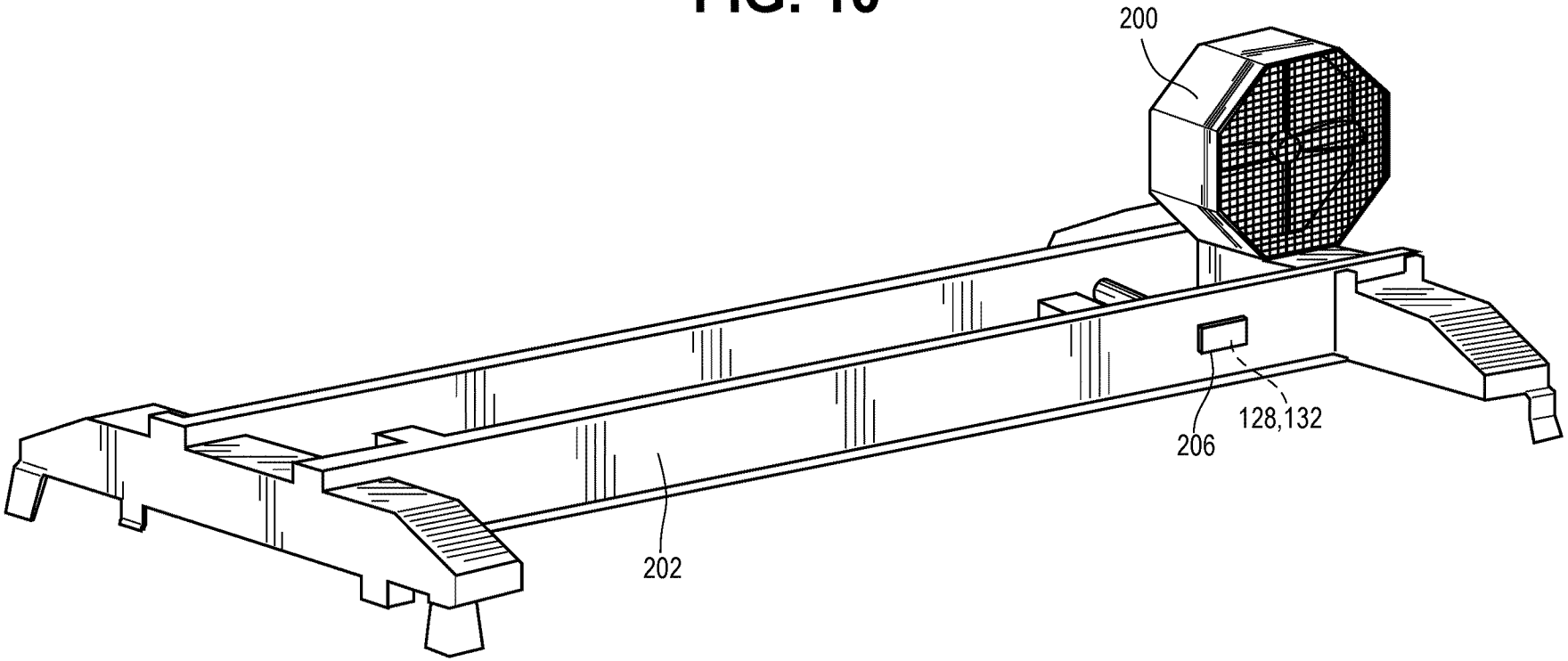
FIG. 10 is a front, top, and right-side isometric view of a lifting device in combination with a load orienting device kit.

A kit may be used to adapt a spreader bar or other lifting device to incorporate the capabilities of the load orienting devices 100,150,170 described above. Referring to FIG. 10, the kit comprises a fan module 200, the controller 128, the direction sensing device 132, and hardware (not shown) to secure the fan module 200, the controller 128, and the direction sensing device 132 to the lifting device 202. The fan module 200 is substantially identical to the first and second fan modules 104,106 described above. The hardware in the kit may include, for example, screws, bolts, and/or other suitable fasteners to attach the fan module 200 to the lifting device 202. In some embodiments, the controller 128 and the direction sensing device 132 are disposed in a metal casing 206 and the hardware includes one or more magnets that secure the metal casing 206 to a lifting device 202. In other embodiments, the hardware may include screws, bolts, or other fasteners suitable to secure controller 128 and the direction sending device 132 to the lifting device 202. In some embodiments, one fan module 200 may be sufficient to add load orienting capabilities to the lifting device 202. However, it should be apparent that one or more additional fan module(s) 200 may be secured to the lifting device 202 if additional thrust is necessary to orient the lifting device 202 (and the load coupled thereto).

In some embodiments, the controller 128 or 204 may be configured to allow an operator to use the remote-control device 130 to orient the load orienting device 100 (or any of embodiments of the load orienting devices disclosed herein) at a first orientation and direct the controller 128 to store the first orientation in a memory thereof. Thereafter, the operator may use the remote-control device 130 to orient the load orienting device 100 at a second orientation and direct the controller 128 to store the second orientation in such memory. Thereafter, the operator may use the remote-control device 130 to direct the controller 128 to automatically orient the load orienting device 100 at a selected one of the first and second stored orientations. It should be apparent to one who has ordinary skill in the art that the controller 128 may be configured to store more than two orientations and the operator may be able to direct the controller 128 using the remote-control device 130 to orient the load orienting device 100 at any of the stored orientations.

Figure 11:
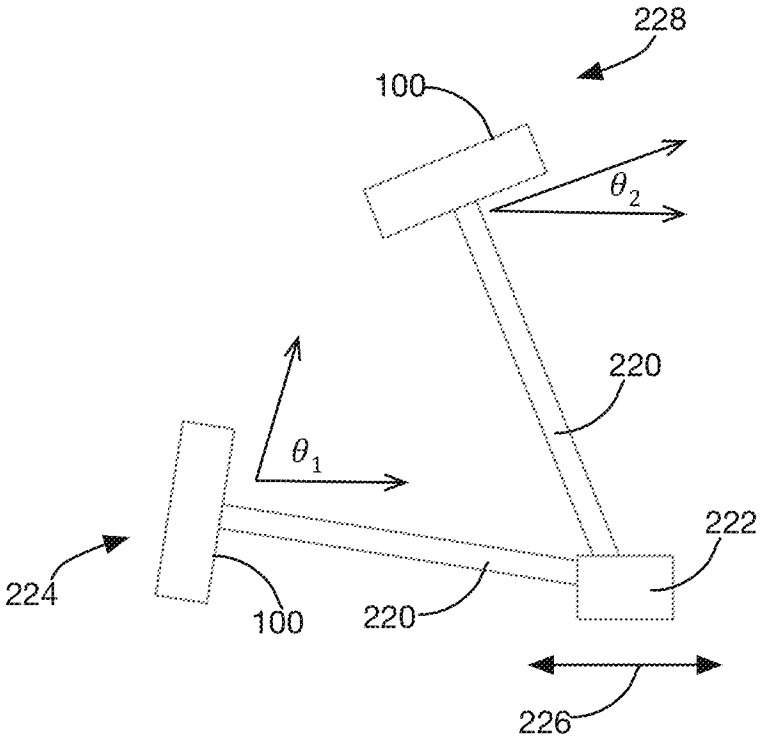
FIG. 11 is a schematic drawing that illustrates operation of the load orienting devices of FIGS. 1-9 and the combination of FIG. 10.

For example, referring to FIGS. 1 and 11, the load orienting device 100 may be coupled to a boom 220 of crane 222 (or other load moving apparatus). The operator may operate the crane 222 so that the load orienting device 100 is positioned at a first location 224 and uses the remote-control device 130 to direct the controller 128 to orient the load orienting device 100 at a first orientation that that is $\theta_1$ degrees relative to a predetermined axis 226 and to store such orientation. When the load orienting device 100 is oriented in the first orientation, the first and second posts 116,118 (FIG. 1) of the load orienting device 100 extend in a direction that is $\theta_1$ degrees relative to the predetermined axis 226.

Thereafter, the operator may operate the crane 222 so that the load orienting device 100 is located at a second location 228 and use the remote-control device 130 to direct the controller 128 to orient the load orienting device 100 at a second orientation that is $\theta_2$ degrees relative to the axis 226 and to store the second orientation. When the load orienting device 100 is oriented at the second orientation, the first and second posts 116,118 (FIG. 1) of the load orienting device 100 extend in a direction that is $\theta_2$ degrees relative to the predetermined axis 226.

The first location 224 may be, for example, where a stack of loads (e.g., construction materials, freight containers, and the like) are located and the first orientation of load orientating device 100 is aligned with such stack. The second location 228 may be, for example, where individual loads of the stack at the first location are to be transported and deposited (e.g., a construction site, a train car, a truck trailer, and the like) and the second orientation may be aligned with such location. To move the stack of loads from the first location 224 to the second location 228, the operator operates the crane 222 to position the load orienting device 100 at the first location 224 and directs the controller 128 to automatically orient the load orienting device 100 in the first orientation. Then, the operator lifts a load at the first location 224 and transports the load to the second location 228. Thereafter, the operator directs controller 128 to automatically orient the load orienting device 100 in the second orientation and deposits the load.

In some embodiments, the operator may use first and second predefined buttons on the remote-control device 130 to direct the controller 128 to record the first orientation and the second orientation. For example, after positioning load orienting device 100 at the first position 224 and adjusting the orientation of the load orienting device 100 to the first orientation, the operator may depress or otherwise actuate a first button on the remote-control device 130 to direct the controller 128 to record the first orientation in a memory thereof. Similarly, after positioning the load orienting device 100 at the second position 228 and adjusting the orientation of the load orienting device 100 to the second orientation, the operator may actuate a second button on the remote-control device 130 to direct the controller 128 to record the second orientation in the memory thereof. In some embodiments, the operator may actuate the first and second buttons for at least a predetermined duration to direct the controller 128 to record the first orientation and the second orientation, respectively.

In some embodiments, the operator may manually adjust the orientation of the load orienting device 100 by, for example, physically rotating the load orienting device 100 about the hook or other attachment device that couples the load orienting device 100 to the crane and then direct the controller 128 to store the orientation of the load orienting device as a first and/or second orientation. Further, in some cases, the operator may use both the remote-control device 130 and manual adjustments to orient the load orienting device 100 at the first and/or second orientation(s).

In one embodiment, when the load orienting device 100 is in operation, the controller 128 adjusts the orientation of the load orienting device 100 in response to commands received from the remote-control device 130. In some embodiments, if no command is received, the default operation of the controller 128 is to maintain the orientation of the load orienting device 100. In other embodiments, the default operation of the controller 128 is to maintain the rotational direction and speed of the load orienting device 100 until a command is received that changes such direction and/or speed.

Figure 12:
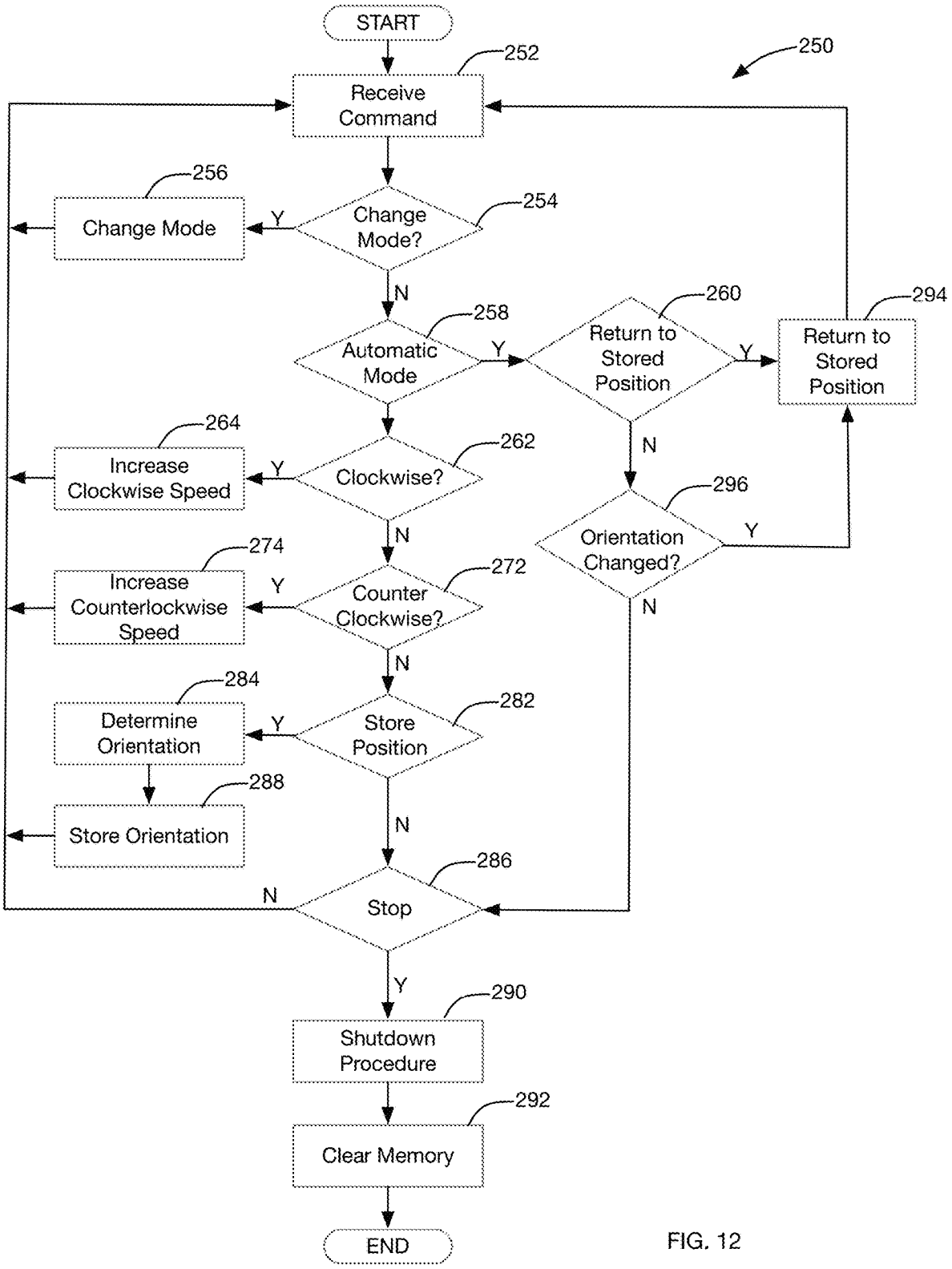
FIGS. 12-14 are flowcharts of steps undertaken by a controller of the load orienting devices of FIGS. 1-9 and the combination of FIG. 10 during operation thereof.

FIG. 12 is a flowchart 250 of the steps undertaken by an embodiment of the controller 128 to operate the load orienting device 100. In the following, the terms clockwise and counterclockwise are descriptive terms used to describe a direction in which the load orienting device 100 is rotated when viewed, for example, downward from a reference position above the load orienting device 100.

Referring to FIGS. 1 and 12, at step 252, the controller 128 waits to receive a command from the remote-control device 130. After a command has been received, at step 254, the controller 128 determines if the command is a directive to change the operating mode of the load orienting device 100. In particular, as described above, the load orienting device 100 may be operated in a manual mode in which the controller 128 rotates the load orienting device 100 in a clockwise or counterclockwise direction in accordance with received commands or in an automatic mode in which the controller 128 automatically orients the load orienting device 100 to a position previously recorded by the operator.

If the controller 128 determines at step 254 that the received command is a directive change the operating mode of the load orienting device 100, the controller 128 at step 256 changes the mode. Specifically, at step 256, if a value of an internal variable used to track the operating mode is associated with manual mode, the controller 128 sets the value of such variable to a value associated with automatic mode. Similarly, if the value of the internal variable is associated with automatic mode, the controller 128 sets the value of such variable to the value associated with manual mode. Thereafter, the controller 128 returns to step 252 to await receipt of another command.

If, at step 254, the controller 128 determines the command received at step 252 is not a directive to change the operating mode then, at step 258, the controller 128 determines if the load orienting device 100 is operating in automatic mode, and if so, proceeds to step 260.

Figure 13A:
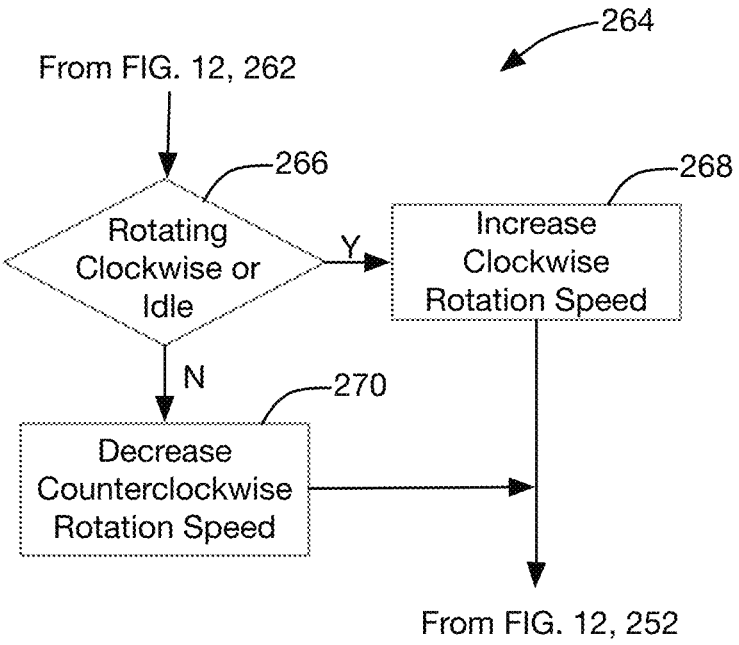

Otherwise, at step 262, the controller 128 determines if the command received at step 262 is to increase clockwise rotation of the load orienting device 100, and if so, proceeds to step 264. FIG. 13A shows a flowchart of the processing undertaken by the controller 128 at step 264. Referring also to FIG. 13A, the controller 128, at step 266, determines if the load orienting device 100 is not rotating (i.e., none of the propellers 110*a*, 110*b*, 112*a*, 112*b* are operating) or is already rotating in a clockwise direction about the line A-A (i.e., the propellers 110*a* and 112*b* are operating). If so, at step 268, the controller 128 increases the speed of the propellers 110*a* and 112*b* by a predetermined amount to increase the clockwise rotational speed of the load orientating device 100. Thereafter, the controller 128 returns to step 252 (FIG. 12) to await receipt of another command. In some embodiments, the controller 128, at step 268, determines if the propellers 110*a* and 112*b* are rotating at a predetermined maximum speed and if so, does not increase the speed thereof.

If, at step 266, the controller 128 determines that the load orienting device 100 is rotating in a counterclockwise direction about the line A-A (i.e., the propellers 110*b* and 112*a* are operating), the controller 128, at step 270, decreases the speed of the propellers 110*b* and 112*a* by a predetermined amount to reduce the counterclockwise rotational speed of the load orienting device 100 or stops the propellers 110*b* and 112*a* if such predetermined amount is greater than the speed of the propellers 110*b* and 112*a*. Thereafter, the controller returns to step 252 (FIG. 12).

Referring once again to FIG. 12, if the controller 128, at step 262, determines that the received command is not a directive to increase clockwise rotation of the load orienting device 100, the controller, at step 272, checks if the received command is a directive to increase counterclockwise rotation of the load orienting device 100 and if so proceeds to step 274.

Figure 13B:
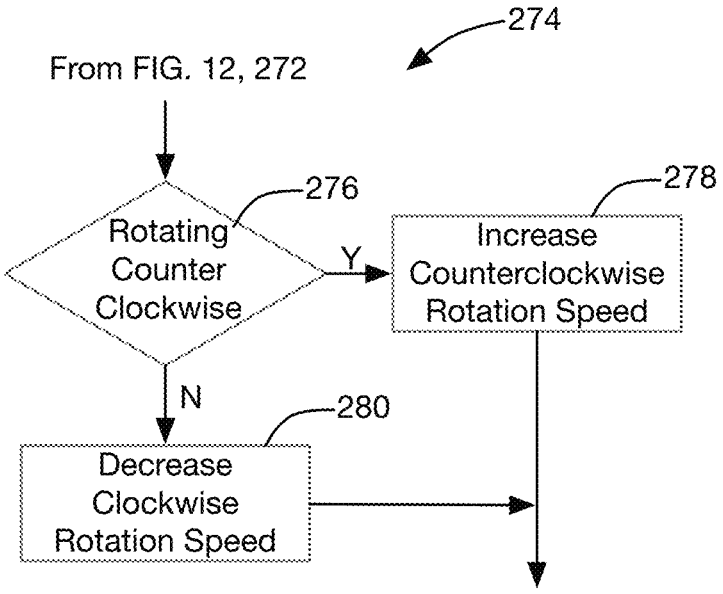

FIG. 13B shows a flowchart of the processing undertaken by the controller at step 274. Referring also to FIG. 13B, at step 276, the controller 128 determines if the load orienting device 100 is not rotating or rotating counterclockwise (i.e., the propellers 110*b* and 112*a* are operating). If so, the controller 128, at step 278, increases the speed of rotation of the propellers 110*b* and 112*a* by a predetermined amount to increase the speed of counterclockwise rotation of the load orienting device 100, and returns to step 252 (FIG. 12). In some embodiments, the controller 128, at step 278, determines if the propellers 110*b* and 112*a* are rotating at a predetermined maximum speed and if so, does not increase the speed thereof.

If, at step 276, the controller 128 determines that the load orienting device 100 is rotating clockwise, the controller 128, at step 280, decreases the rotation speed of the propellers 110*a* and 112*b* by a predetermined amount to decrease the speed of clockwise rotation of the load orienting device 100 or stops rotation of the propellers 110*a* and 112*b* if such predetermined amount exceeds the speed of such propellers. Thereafter the controller 128 returns to step 252 (FIG. 12).

If, at step 272, the controller 128 determines that the command received at step 252 is not a directive to increase the counterclockwise rotation of the load orienting device 100, the controller, at step 282, determines if the command is a directive to store the current orientation of the load orienting device 100. If so, the controller proceeds to step 284, otherwise the controller proceeds to step 286.

It should be apparent that if the command received at step 252 is to store the current orientation of the load orienting device 100, such command includes an indication of an orientation number to associate with the stored orientation. For example, as described above in connection with FIG. 11, an operator may actuate first and second predefined buttons on the remote-control device 130 to specify storing of a first and a second orientations, respectively, and a predetermined orientation number is associated with each such button. Alternately, in some embodiments the remote-control device 130 may include a keypad (either physical or on a touch screen) that allows the operator to specify a orientation number to associate with the stored orientation. The command received at step 252 to store the orientation includes an indication by the operator of the orientation number to associate with the stored orientation.

At step 284, the controller 128 obtain the current orientation of the load orienting device 100 from the direction sensing device 132, at step 288, and stores the orientation in a memory thereof at a location associated with the orientation number, at step 288. Thereafter, the controller 128 returns to step 252 to await a further command.

At step 286, the controller 128 determines if the command received at step 252 is a directive to stop operation of load orienting device 100. If so, the controller 128 begins a shutdown procedure, at step 290. Otherwise, the controller 128 returns to step 252 to await receipt of another command.

Figure 5:
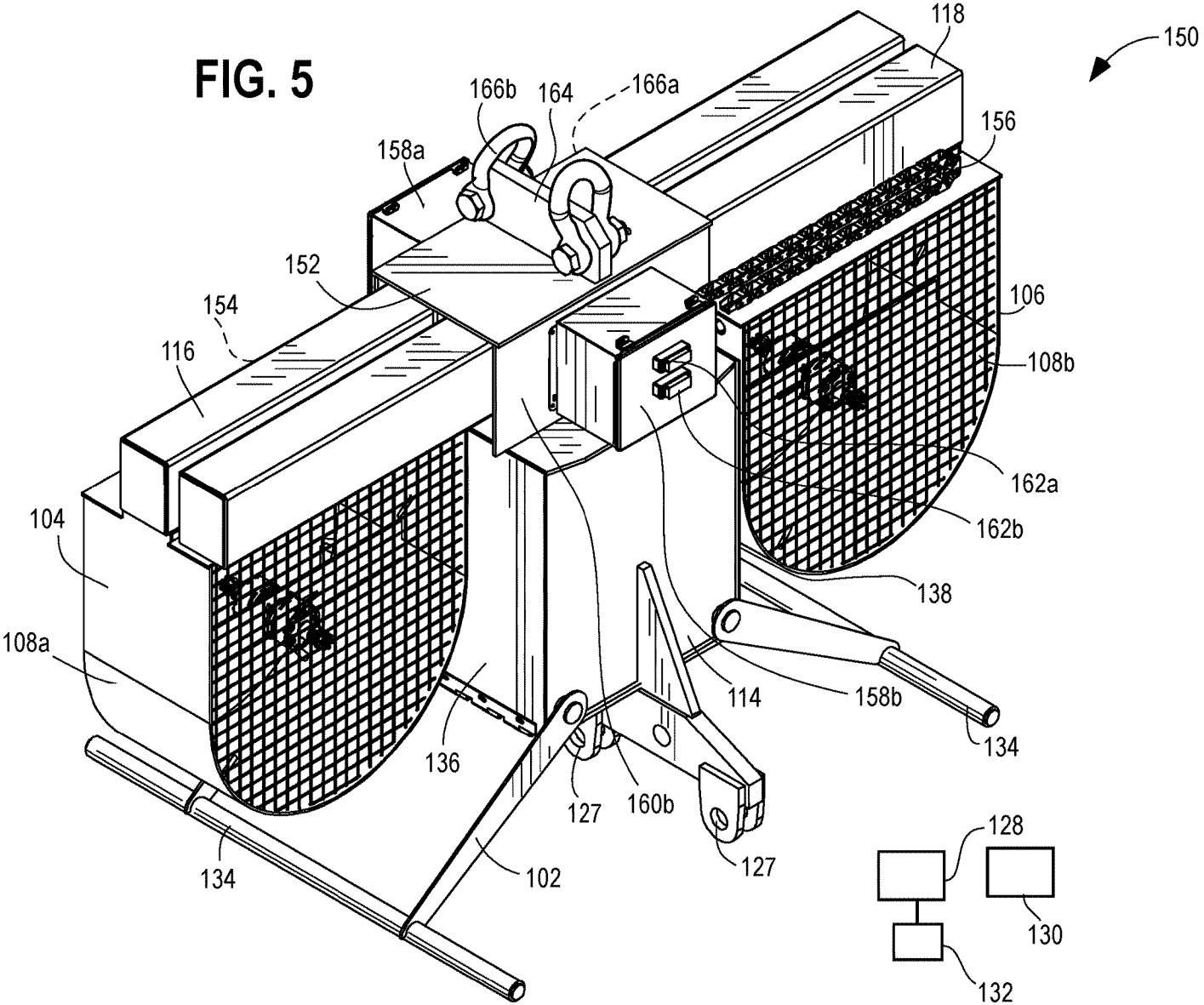
FIG. 5 is a front, top, and left-side isometric view of another embodiment of a load orienting device.
Figure 6:
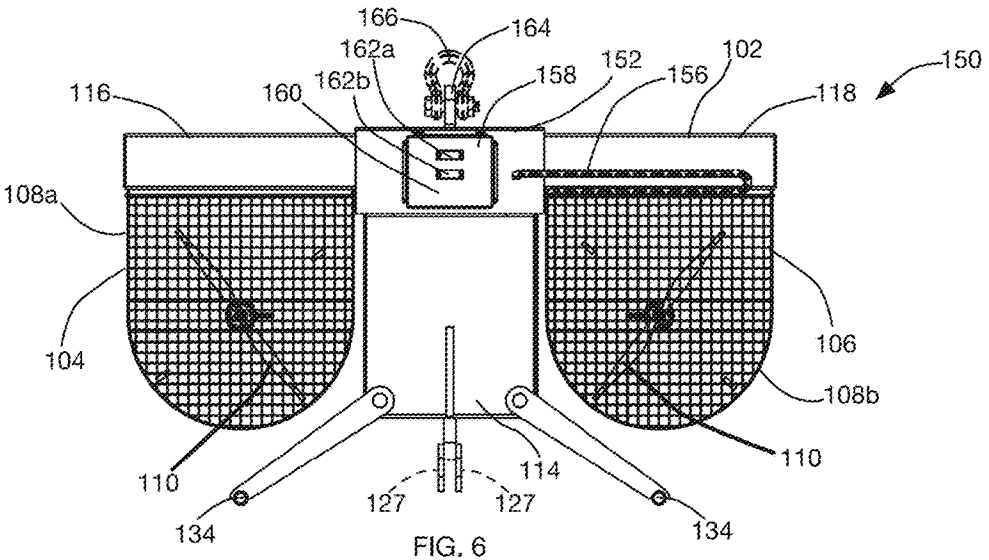
FIGS. 6 and 7 are front elevational views of the load orienting device of FIG. 5.
Figure 7:
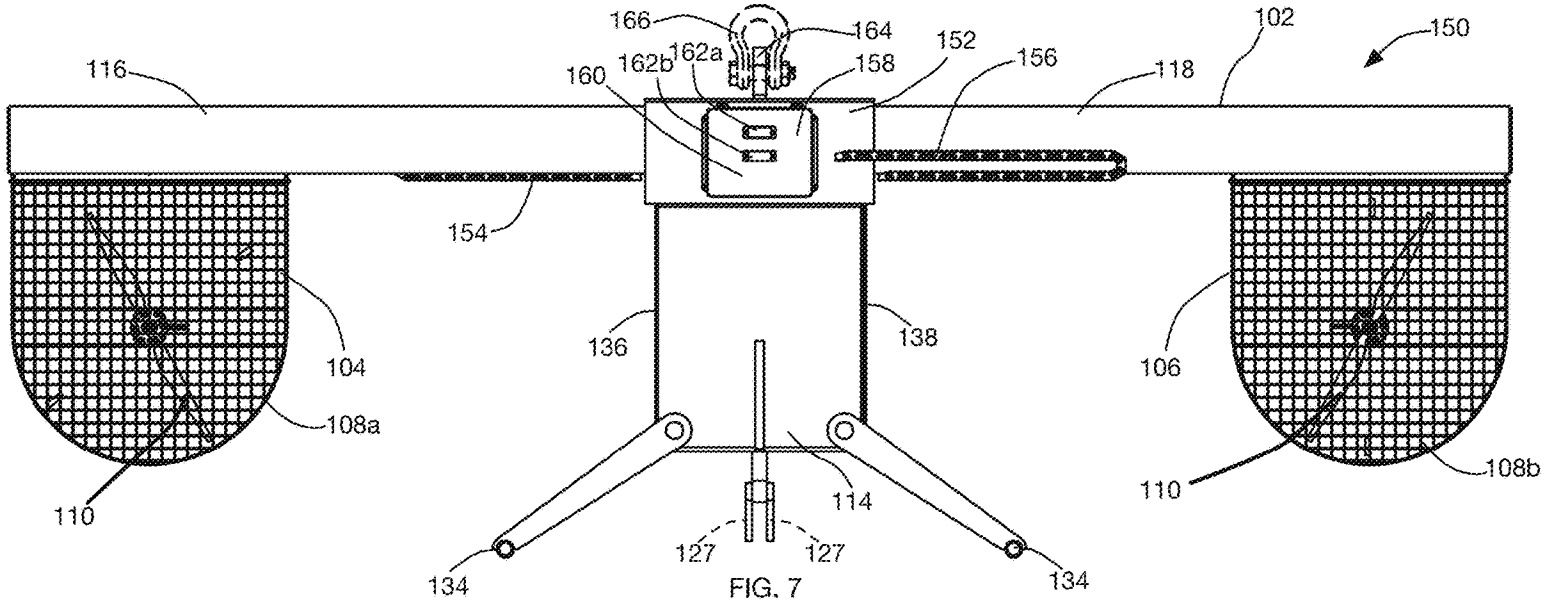
Figure 8:
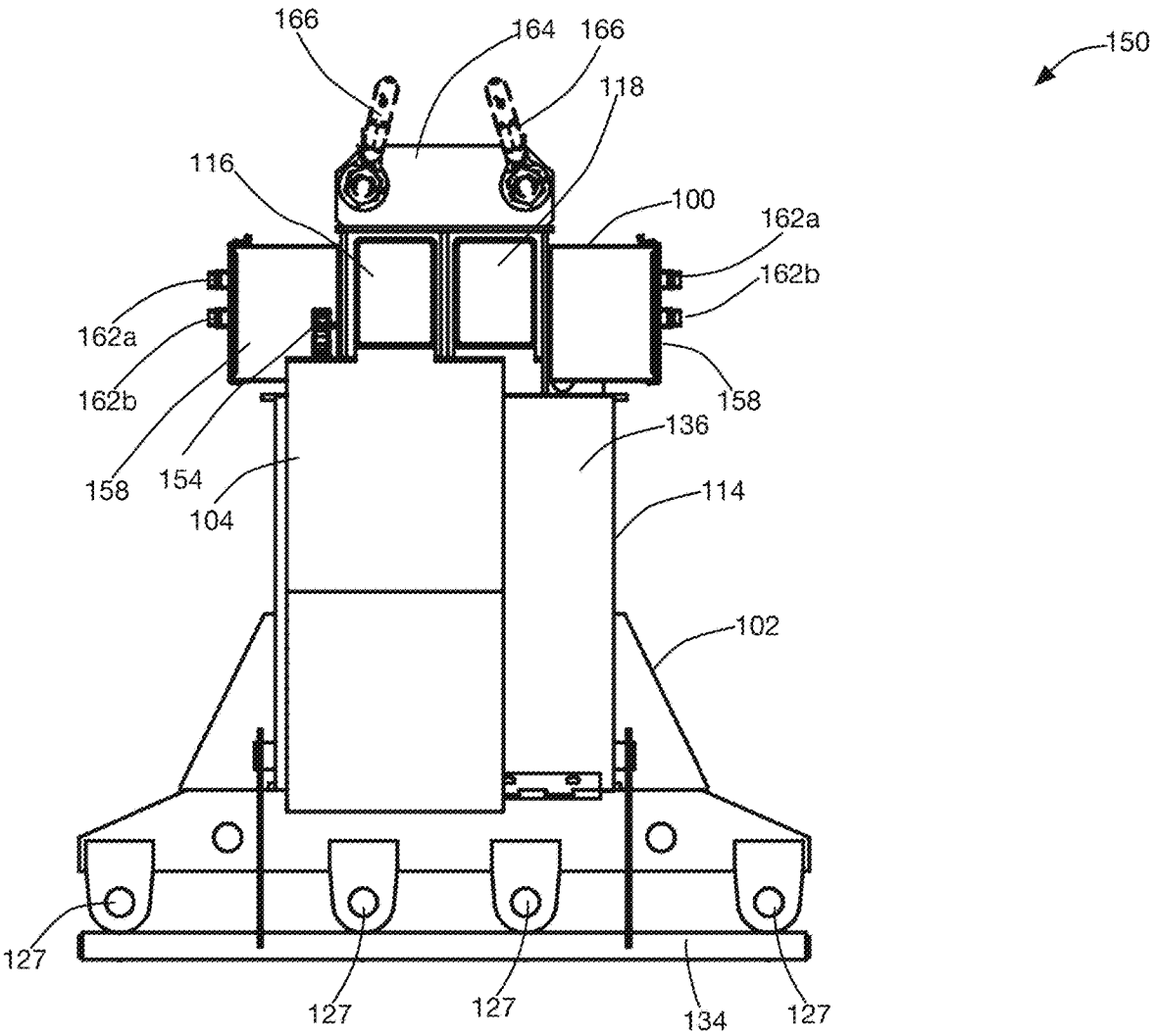
FIG. 8 is a left-side elevational view of the load orienting device of FIG. 5.

During the shutdown procedure, at step 290, the controller 128 stops rotation of any propellers 110 and 112 that are rotating in a controlled fashion and turns off the monitoring device 158 (FIG. 5). Thereafter, the controller 128 also clears any orientations stored, at step 292, and exits.

If, at step 258, the controller 128 determines that the load orienting device 100 is operating in automatic mode, the controller 128, at step 260, determines if the command received at step 252 is a directive to return to an orientation previously stored at step 288. If so, the controller 128 proceeds to step 294, otherwise the controller 128 proceeds to step 296. It should be apparent that if the command received at step 252 is to return to a previously stored orientation, such command includes an indication of the orientation number associated with the previously stored orientation.

A step 294, the controller 128 causes the load orienting device 100 to return to the orientation associated with the orientation number specified in command received at step 252 and then returns to step 252 to await another command.

At step 296, the controller 128, determines if the orientation of the load orienting device 100 has changed from the stored orientation most recently returned to at step 292. If so, the controller 128 proceeds to step 294 to return once again to orient the load orienting device 100 in accordance with such orientation. Otherwise, the controller 128 proceeds to step 286 (described above).

Figure 14:
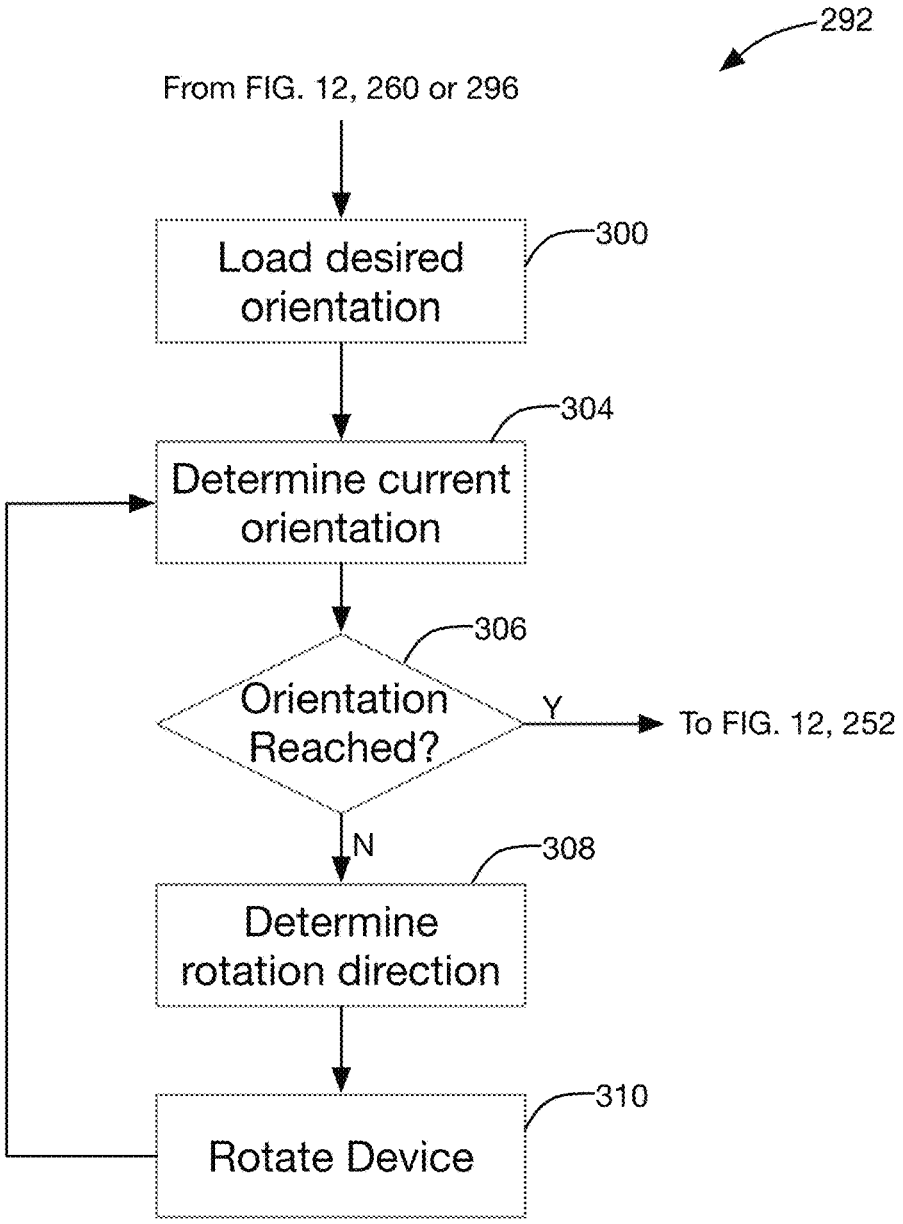

FIG. 14 is a flowchart of the steps undertaken by the controller 128 at step 294 of FIG. 12. Referring, to FIG. 14, at step 300, the controller 128 loads the orientation associated with the position number specified in the most recently received return to orientation command received at step 252 (i.e., the desired orientation) of FIG. 12. At step 304, the controller 128 determines the current position of the load orienting device 100.

At step 306, the controller 128 determines whether the desired orientation and the current orientation are identical, or in some cases, within a predetermined amount (e.g., within ±2 degrees). If so, the controller 128 returns to step 252 (FIG. 12) to await another command, otherwise the controller 128 proceeds to step 308.

At step 308, the controller 128 determines whether the load orienting device 100 should be rotated clockwise or counterclockwise to most quickly reach the desired orientation. At step 310, the controller 128 operates the propellers 110,112 as necessary to cause the load orienting device 100 to rotate in a clockwise or counterclockwise direction as described above. Thereafter, the controller 128 returns to step 304. It should be apparent that the controller 128 may include delays, statistical process control techniques, and other measures apparent to those who have ordinary skill in the art to avoid effects from hysteresis, continuously hunting for the desired orientation, and/or over/under rotation of the load orienting device 100.

Figure 15:
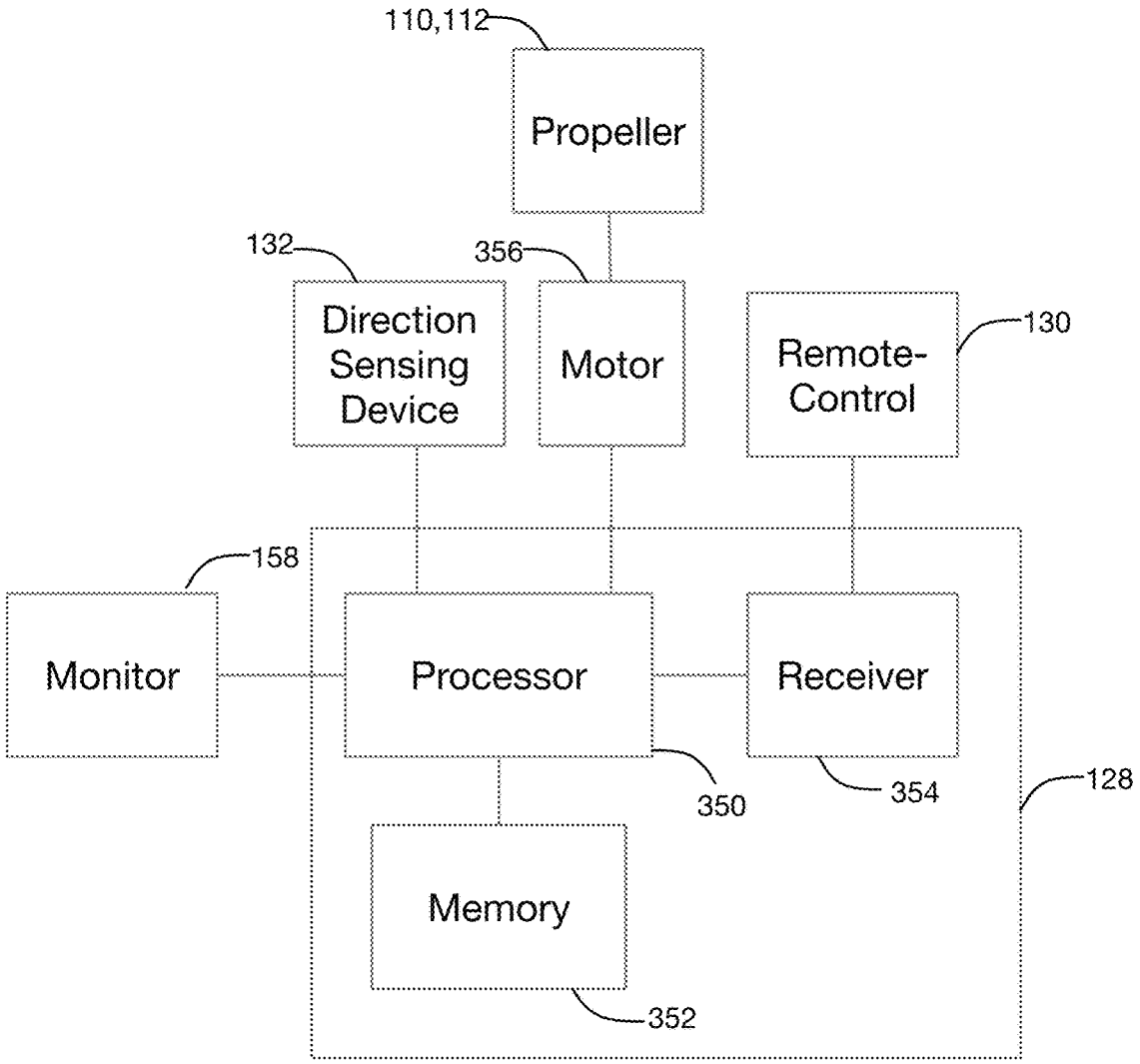
FIG. 15 is a block diagram of a controller of the load orienting devices of FIGS. 1-9 and the combination of FIG. 10.
Figure 16:
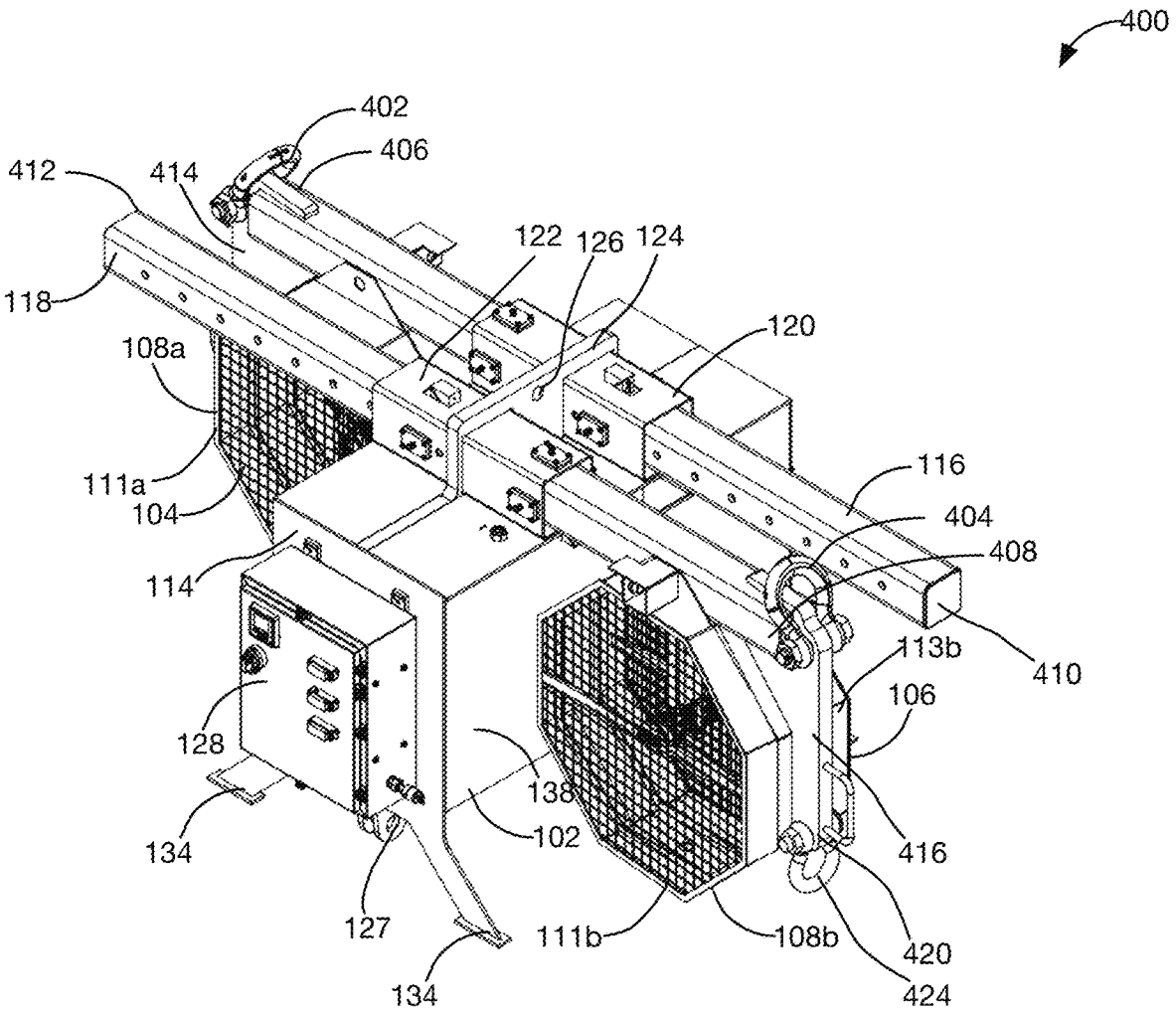
FIG. 16 is a front, top, right-side view of another embodiment of a load orienting device with posts thereof in a retracted position.
Figure 17:
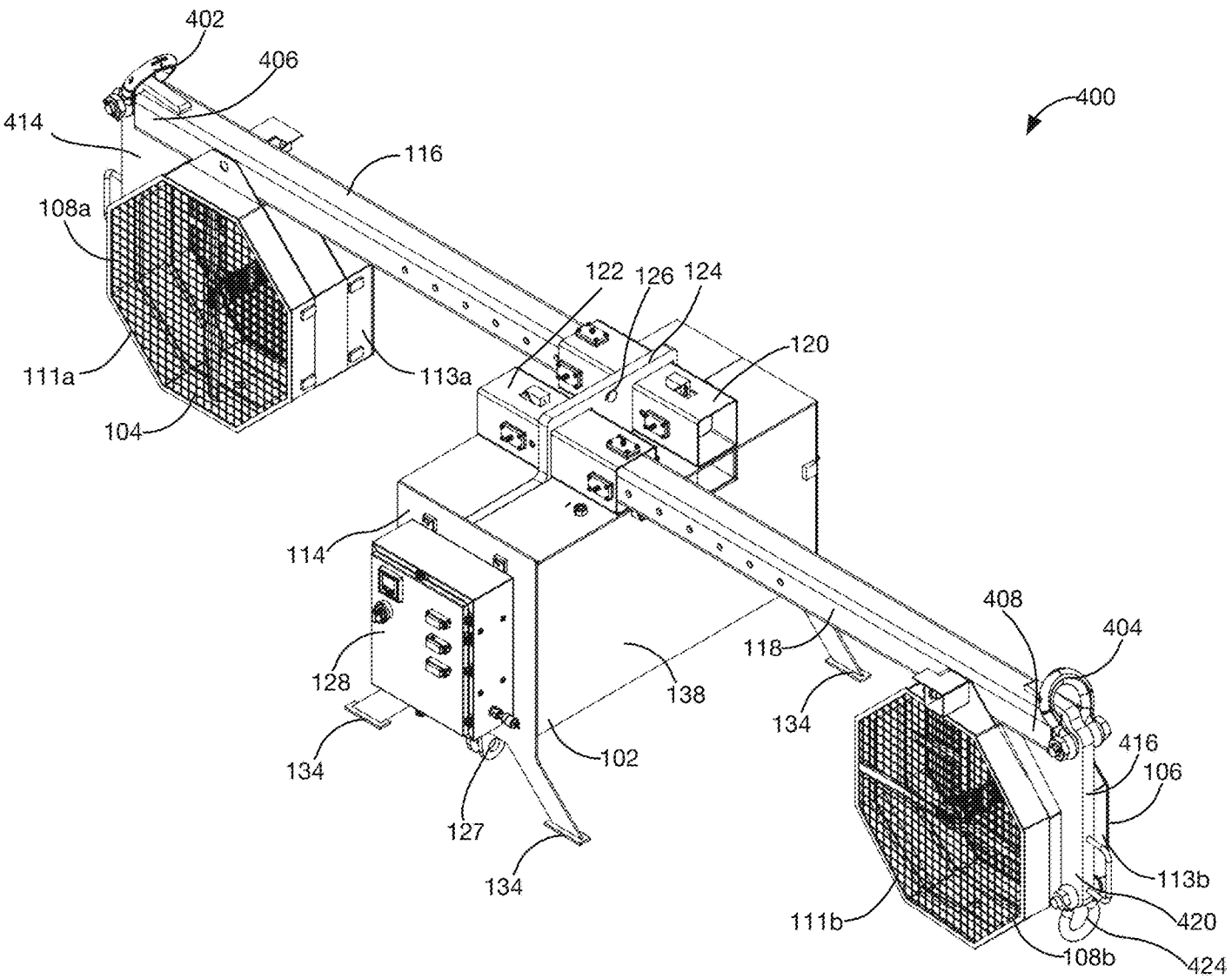
FIG. 17 is a front, top, right-side view of the load orienting device of FIG. 16 with posts thereof in an extended position.
Figure 18:
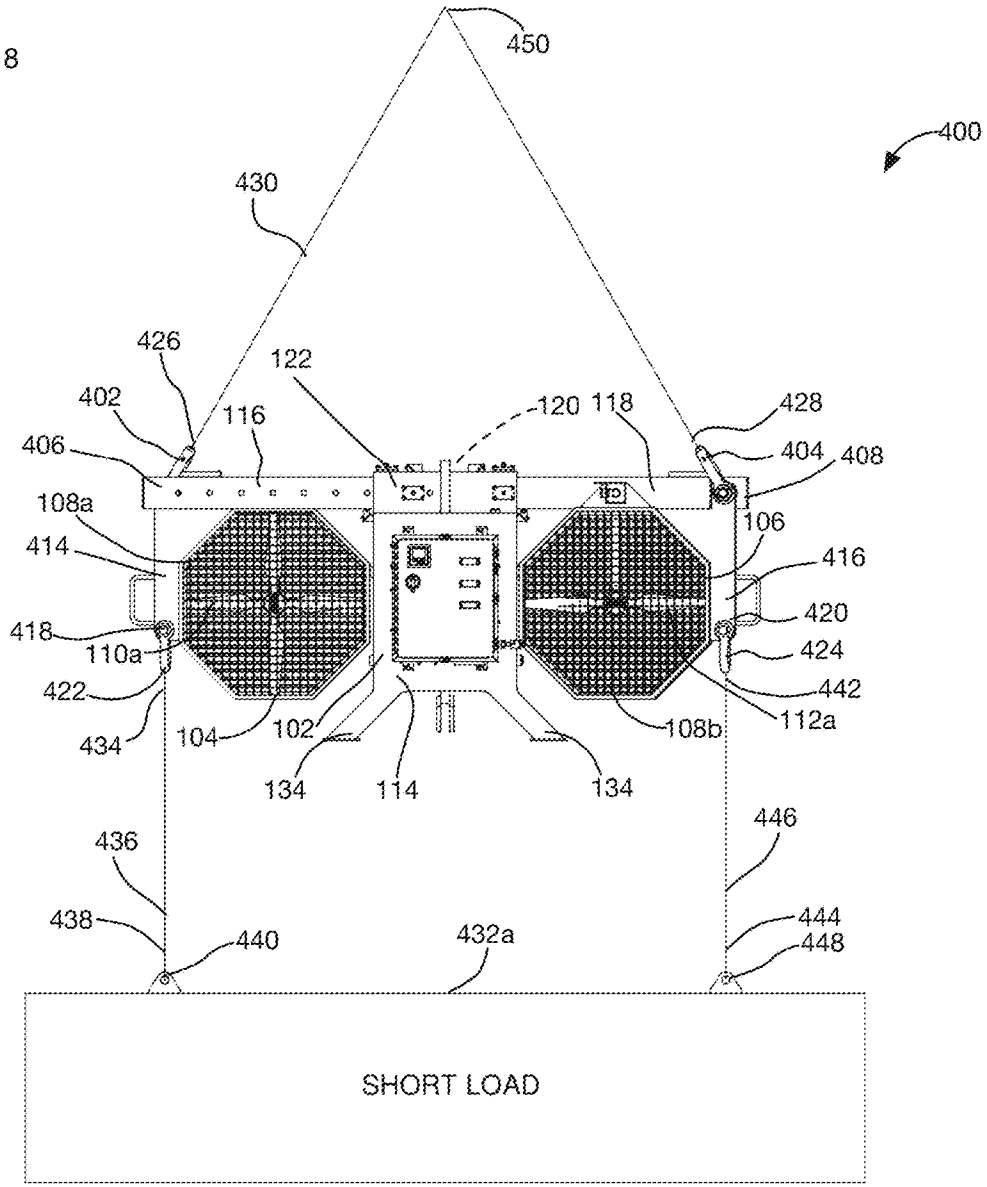
FIGS. 18 and 19 are front elevational views of the load orienting device of FIG. 16.
Figure 19:
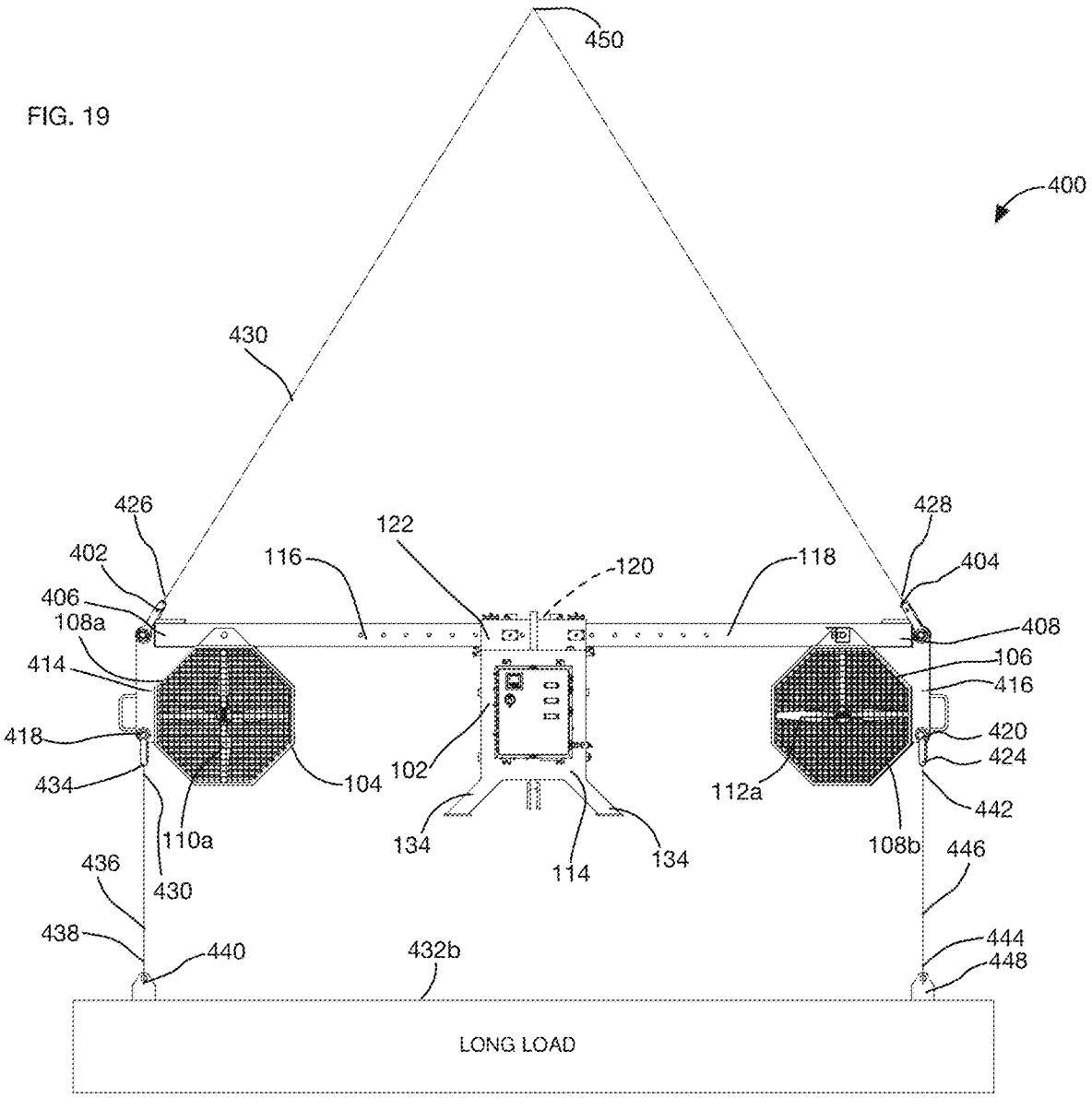

Referring to FIG. 15, in one embodiment the controller 128 is a computer having one or more processor(s) 350, one or more memory devices 352, and a radio-frequency receiver 354. The memory device(s) 352 has/have executable instruction stored therein that when executed by the processor 350 cause the processor to receive and process commands received from the remote-control device 130 by the radio-frequency receiver 354; to cause actuate one or motor(s) 356 to rotate the first and/or second propellers 110,112 in accordance with the received commands as described above; receive direction information from the direction sensing device 132; and operate the monitor 158.

In some embodiments, a load orienting device may include hardware to couple the load orienting device with a crane and/or a load to be moved. In such embodiments, the load orienting device includes the functionality typically provided by a spreader bar.

Referring to FIGS. 16-19, the load orienting device 400 includes first and second crane attachment apparatuses 402, 404 such as eyes, shackles, through holes, and the like that are secured to the first and second posts 116,118, respectively. In some embodiments (as shown in FIGS. 16-19), the first fan module 104 is secured proximate a first distal end 406 of the first post 116 and the second fan module 106 is secured proximate a first distal end 408 of the second post 118. In addition, the first and second attachment apparatuses 402,404 are disposed proximate to the first distal ends 406,408 of the first and second posts 116,118, respectively.

In other embodiments (not shown), the first and second fan modules 106,106 are disposed proximate to the first distal ends 406,408, of the first and second posts 116,118, respectively, and the crane attachment apparatuses 402,404 are secured to second distal ends 410,412 (opposite the first distal ends 406,408) of the first and second posts 116,118, respectively.

Extension members 414,416 are secured to the first and second posts, 116,118, respectively. In some embodiments, such extension members 414,416 extend downward toward the ground from the posts 116,118. In other embodiments, the extension members 414,416 extend horizontally outward from the posts 116,118, or at any angle relative to the posts 116,118.

In some embodiments, the extension members 414,416 are secured proximate the first ends 406,408 as shown in FIGS. 16-19. Alternately, the extension members 414,416 may be secured proximate the second distal ends 410,412. The extension members 414,416 may be secured to the first and second posts 116,118, respectively, by, for example, welding or fastening with a screw, a bolt, and the like. In some cases, the extension members 414,416 may be formed integrally with the posts 116,118.

Secured to distal ends 418,420 of the extension members 414,416, respectively, are first and second load attachment apparatuses 422,424, respectively. The load attachment apparatus 422,424 are eyes, shackles, through holes, and the like.

In operation of the load orienting device 400, first and second opposite ends 426,428 of a sling 430 formed from a chain, cable, chain, rope, and the like is attached to the first and second crane attachment members 402,404, respectively. In some embodiments, the first and second ends 426,428 of the sling 430 may be terminated in hooks (not shown) and these hooks may be passed through the crane attachment members 402,404 to attach the sling 430 to the load orienting device 400. Other ways of attaching the first and second ends 426,428 of the sling to the crane attachment members 402,404 apparent to one who has ordinary skill in the art may be used.

In addition, to lift and orient a load 432*a* or 432*b*, a first end 434 of a first cable 436 is secured to the first load attachment apparatus 422 of the load orienting device 400 and a second end 438 (opposite the first end 434) of the first cable 436 is attached to a first coupling 440 of the load 438. Similarly, first and second opposite ends 442,444 of a second cable 446 are secured to the second load attachment apparatus 424 of the load orienting device 400 and a second coupling 448 of the load 438, respectively.

In some embodiments, the first and second opposite ends 434,438 of the first cable 436 may be terminated in hooks (not shown) and these hooks may be passed through the first load attachment apparatus 422 and the first coupling 440 respectively. In a like manner, the first and second opposite ends 442,444 of the second cable 446 may be terminated in hooks (not shown) and these hooks may be passed through the second load attachment apparatus 424 and the second coupling 448, respectively. Other ways of attaching first ends 434,442 of the first and second cables 436,446, respectively, to the load attachment apparatus 432 and attaching the second ends 438,444 of the first and second cables 436,446, respectively, to the couplings 440,448 apparent to one who has ordinary skill in the art may be used.

After the sling 430 and the load 432 are secured to the load orienting device 400 as described above, a load line (not shown) of a crane (not shown) is secured proximate a midpoint 450 of the sling 430 to lift the load orienting device 400 and the load 432 secured thereto.

The order in which the sling 430 is secured to the load orienting device 400, the load line of the crane is secured to the sling 430, and the cables 436,446 are secured to the load 432 may be varied as long as the sling 430 is secured to the load orienting device 400 and the cables 436,446 are secured to the load 432 before the crane is used to lift the load orienting device 400 and the load 432. For example, the sling 430 may be secured to the load orienting device 400 and the load line of the crane may be secured to the sling 430. The crane may then be operated to lift and position the load orienting device 400 over the load 432 to facilitate securing the cables 436,446 to the load 432. Thereafter, the crane may be operated to lift both the load orienting device 400 and the load 432.

In some embodiments, the first and second posts 116,118 may be inserted into or retracted from the first and second tubular sections 120,122, respectively so that a distance between the first and second load attachment apparatus 422,424 is substantially identical to the distance between the first and second couplings 440,448 of the load 432 so that the first and second cables 434,444 are substantially vertical. This facilitates maintaining the load 438 and the first and second posts 116,118 in a substantially horizontal position when the load 438 is lifted. Further, retracting and extending the first and second posts 116,118 in this manner allow the load orienting device 400 to be used with relatively short loads (e.g., load 432*a*) and relatively long loads (e.g., load 432*b*).

Figure 20:
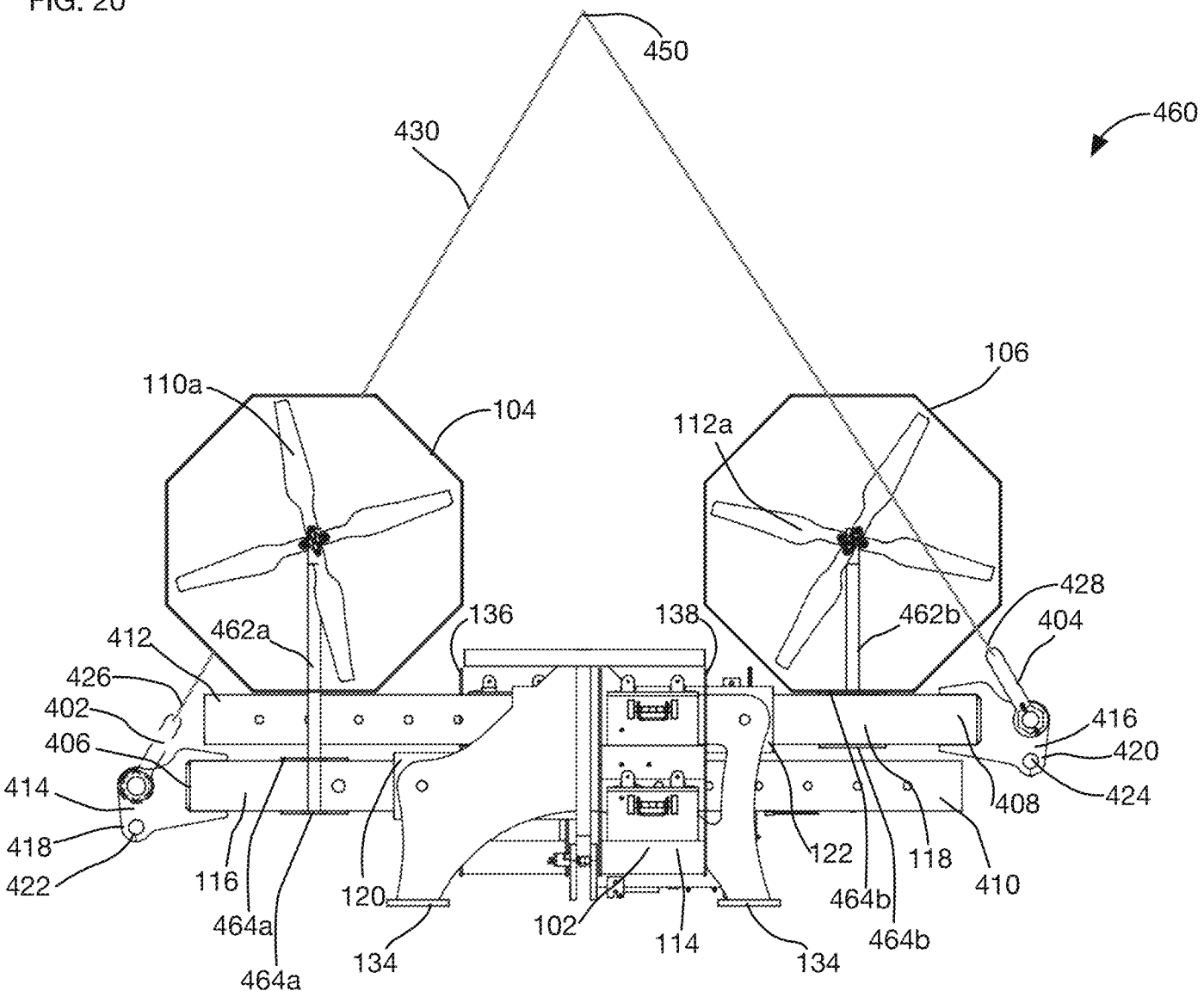
FIG. 20 is a front elevational view of yet another embodiment of a load orienting device, with certain elements omitted for clarity.
Figure 21:
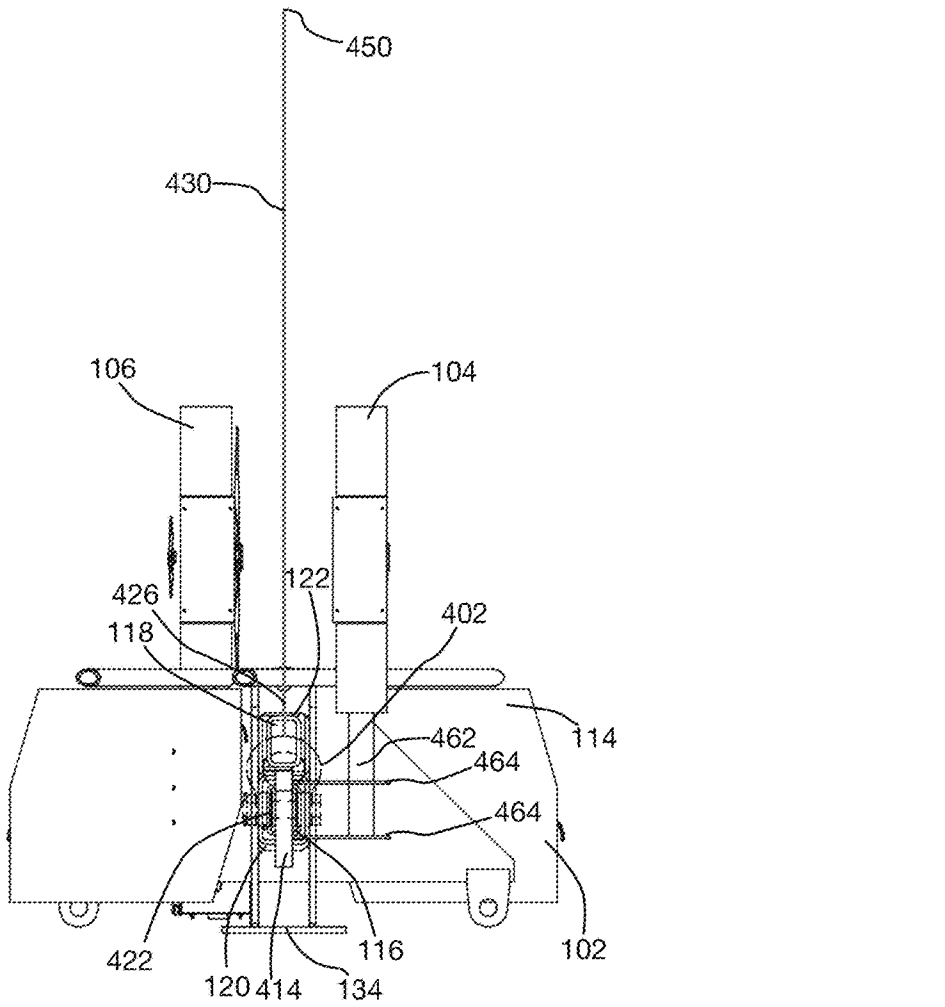
FIG. 21 is a left-side elevational view of the load orienting device of FIG. 20.
Figure 22:
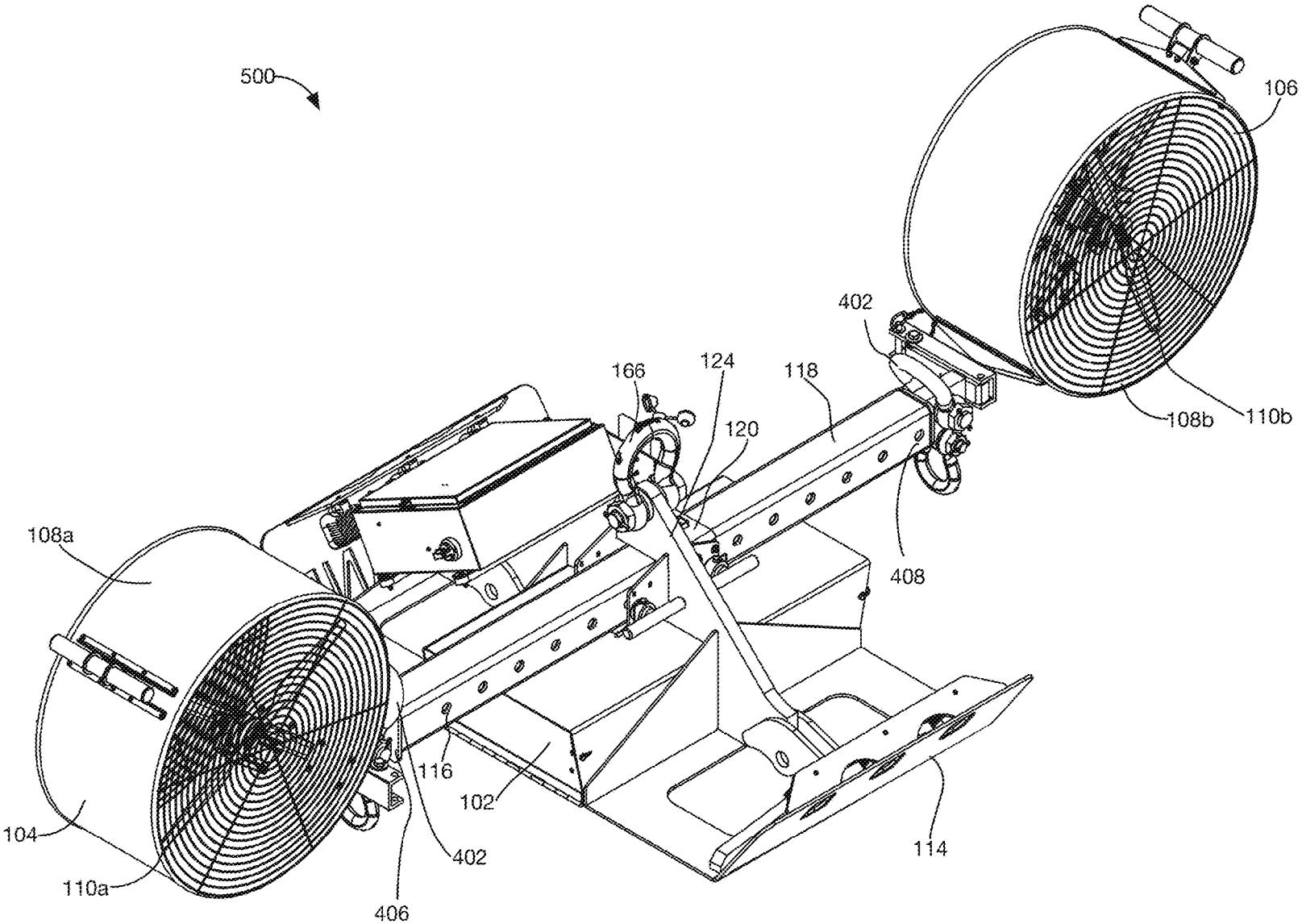
FIG. 22 is a front, top, left-side view still another embodiment of a load orienting device with posts in a retracted position.

Referring also to FIGS. 20 and 21, a load orienting device 460 is substantially identical to the load orienting device 400 shown in FIGS. 16-19 except the posts 116,118 are stacked atop one another vertically and the first and second fan modules 104,106 are spaced apart front to back and disposed atop the posts 116,118, respectively. When used with the load orienting device 460 the sling 430 is disposed intermediate the first and second fan modules 104,106. In such embodiments, the first and second fan modules 104,106 are secured to the first and second posts 116,118 by attachment members 462*a*,462*b*.

Each attachment 462 includes a substantially vertical post 464 that is secured to the fan module 104 or 106 and extends downward. The vertical post 464 is secured to one or more horizontal plates that extend inward and are attached to a top and bottom surface of the corresponding post 116 or 118.

Referring to FIGS. 22-26, another embodiment of the load orienting device 500 is substantially identical to the load orienting device 400 and 460 disclosed above except the first post 116 is a hollow tube and the second post 118 is slidably disposed inside the hollow tube. Further, the first and second fan modules 104,106 are secured to the first and second posts 116,118, by first and second pivotable arms 502,504, respectively.

Figure 23:
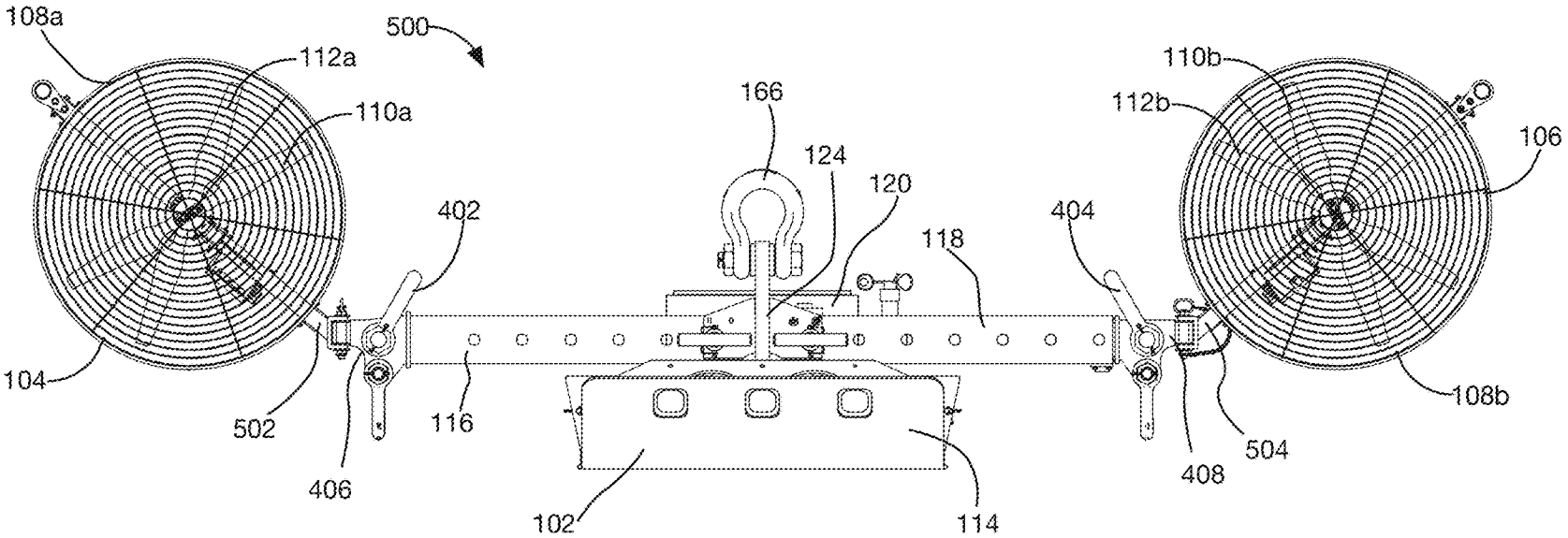
FIGS. 23 and 24 are front elevational views of the load orienting device of FIG. 22 with posts in a retracted and extended positions, respectively, and pivotable arms in an extended position.
Figure 24:
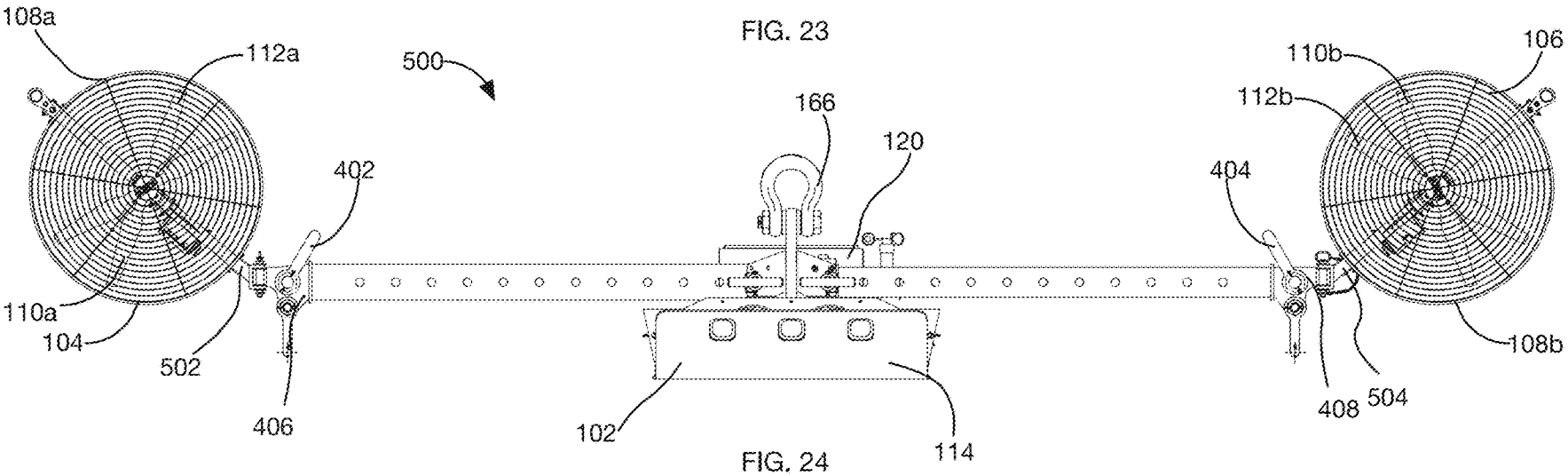

The second post 118 may be slid inward into the first post 116 to reduce the distance between the first and second fan modules 104,106 (as shown in FIG. 23) or slid outward to increase the distance between first and second fan modules 104,106 (as shown in FIG. 24). In some embodiments, a bolt, a pin, a screw, and the like (not shown) may be secured to the first and/or second posts 116,118 after selecting a desired distance between the first and second fan modules 104,106 to prevent further relative movement between these posts (and fan modules).

The first pivotable arm 502 is secured proximate one end of the first post 116 by a hinge such that the first pivotable arm 502 may be rotated about an axis perpendicular to the first post 116. After the first pivotable arm 502 is rotated about such axis to a desired position, a locking pin (not shown) may be used to prevent further rotation of the first pivotable arm 502.

Similarly, the second pivotable arm 504 is secured proximate one end of the second post 118 by a hinge such that the second pivotable arm 504 may be rotated about an axis perpendicular to the second post 118. After the second pivotable arm 504 is rotated about such axis to a desired position, a lock pin (not shown) may be used to prevent further rotation of the second pivotable 504.

Figure 25:
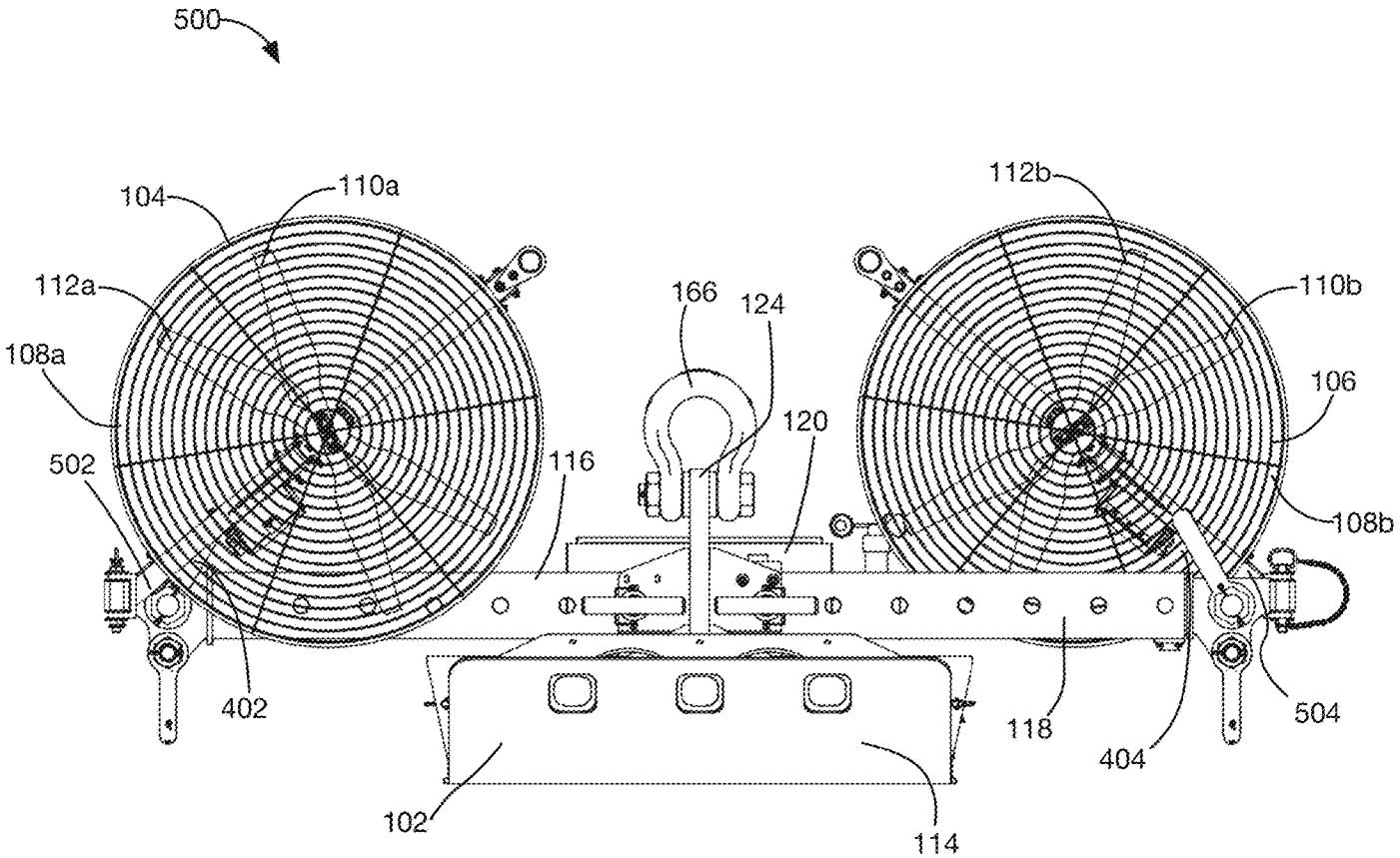
FIG. 25 is a front elevational view of the load orienting device of FIG. 22 in a storage/transport mode.
Figure 26:
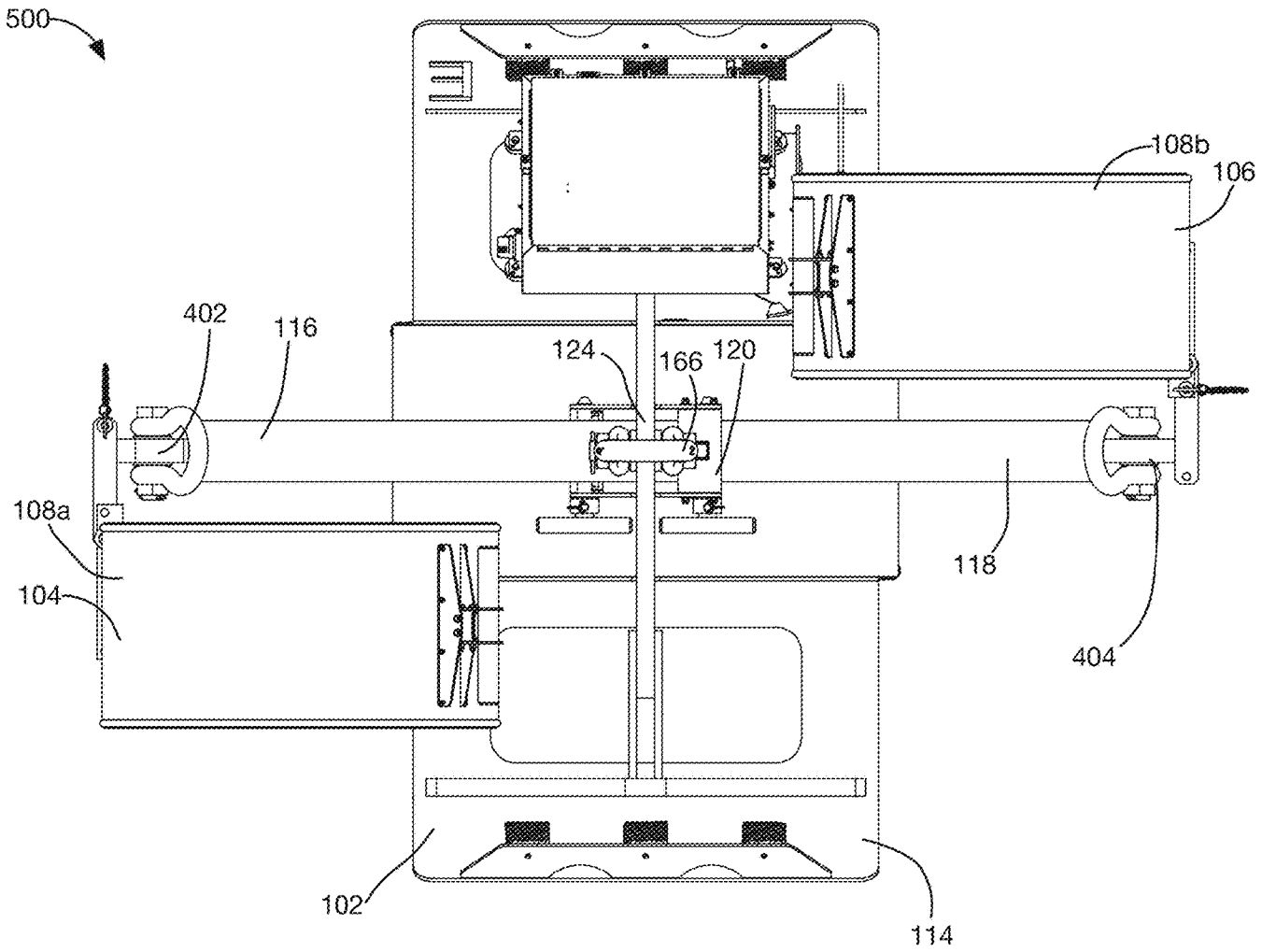
FIG. 26 is a top planar view of the load orienting device of FIG. 22 in a storage/transport mode.

The first and second pivotable arms 502,504 may be rotated inward toward the plate 124 (as shown in FIGS. 25 and 26), and optionally locked into place, for storage and transport of the load orienting device. In one embodiment, the first and second pivotable arms 502,504 are rotated relative to the first and second posts 116,118 to form an angle of approximate 135 when the load orienting device 500 is in an operational mode and to form an angle of approximately 45 degrees when the load orienting device 500 is in a storage/transport mode.

In some embodiments, the load orienting device 500 includes both a loop 166 through which a crane hook may be passed and crane attachment apertures 402,404 to which a sling identical to the sling 430 (FIGS. 18-20) may be attached. Thus, the load orienting device 500 may be lifted using the crane hook or the sling 430 as described above.

The controller 128 may be used to operate the embodiments of the load orienting devices 400, 460, and 500 in a manner identical to that described in FIGS. 11-14 in connection with operation of the load orienting device 100.

It should be apparent to those who have skill in the art that any combination of hardware and/or software may be used to implement components of the controller 128 described herein. It will be understood and appreciated that one or more of the processes, sub-processes, and process steps described in connection with FIGS. 12-14 may be performed by hardware, software, or a combination of hardware and software on one or more electronic or digitally-controlled devices. The software may reside in a software memory (not shown) in a suitable electronic processing component or system such as, for example, one or more of the functional systems, controllers, devices, components, modules, or sub-modules depicted in FIGS. 1A, 5, and 15. The software memory may include an ordered listing of executable instructions for implementing logical functions (that is, "logic" that may be implemented in digital form such as digital circuitry or source code, or in analog form such as analog source such as an analog electrical, sound, or video signal). The instructions may be executed within a processing module or controller (e.g., controller 128), which includes, for example, one or more microprocessors, general purpose processors, combinations of processors, digital signal processors (DSPs), field programmable gate arrays (FPGAs), application-specific integrated circuits (ASICs), and/or graphics processing units (GPUs). Further, the schematic diagrams describe a logical division of functions having physical (hardware and/or software) implementations that are not limited by architecture or the physical layout of the functions. The example systems described in this application may be implemented in a variety of configurations and operate as hardware/software components in a single hardware/software unit, or in separate hardware/software units.

Depending on certain implementation requirements, the embodiments described can be implemented in hardware and/or in software. The implementation can be performed using a non-transitory storage medium such as a digital storage medium, for example, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according comprise a data carrier having electronically readable control signals, which are capable of cooperating with a processor, a controller, or a programmable computer system, such that one of the methods described herein is performed.

Generally, embodiments disclosed herein can be implemented as a computer program product with a program code, the program code being operative for performing one of the methods when the computer program product runs on a computer. The program code may, for example, be stored on a machine-readable carrier.

Other embodiments comprise the computer program for performing one of the methods described herein, stored on a machine-readable carrier.

In other words, an embodiment, therefore, may include a computer program having a program code for performing one of the methods described herein, when the computer program runs on a processor, a controller, and/or a computer.

A further embodiment of the system described herein is, therefore, a storage medium (or a data carrier, or a computer-readable medium) comprising, stored thereon, the computer program for performing one of the methods described herein when it is performed by a processor. The data carrier, the digital storage medium or the recorded medium are typically tangible and/or non-transitory. A further embodiment of the present invention is an apparatus as described herein comprising a processor and the storage medium.

A further embodiment of the system describe herein is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are preferably performed by any hardware apparatus.

While particular embodiments of the present invention have been illustrated and described, it would be apparent to those skilled in the art that various other changes and modifications can be made and are intended to fall within the spirit and scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A load orienting device, comprising:

a frame;

first and second posts disposed on the frame;

first and second propellers disposed on the first and second posts, respectively, wherein the first and second posts are movable to adjust a distance between the first and second propellers; and a controller that:

receives a command to rotate the load orienting device in a first direction, and in response determines a direction in which the load orienting device is rotating, increases a rotation speed of the first and second propellers if the load orienting device is rotating in the first direction, and decreases the rotation speed of the first and second propellers otherwise.

2. The load orienting device of claim 1, further including third and fourth propellers, wherein the first and third propellers are disposed in a first fan module and the second and fourth propellers are disposed in a second fan module, and the first and second fan modules are secured to the first and second posts, respectively.

3. The load orienting device of claim 2, wherein the controller operates the first and second propellers to generate airflow parallel to the first direction and operates the third and fourth propellers to generate airflow parallel to a second direction, wherein the first direction is opposite the second direction.

4. The load orienting device of claim 1, further including a remote control and the controller changes the orientation of the load orienting device in response to a command received from remote control.

5. The load orienting device of claim 4, wherein the controller receives from the remote control a first command to store a first orientation, a second command to store a second orientation, a further command to orient the load orienting device to a selected one of the first and second orientations.

6. The load orienting device of claim 1, further including a direction sensing device, wherein the controller receives from a remote control a command specifying a particular angle, the controller uses the direction sensing device to determine a direction the load orienting device is pointing, and the controller operates the first and second propellers to change the direction the load orienting device is pointing in accordance with the particular angle.

7. The load orienting device of claim 1, wherein the controller operates the first and second propellers to maintain an orientation of the load orienting device.

8. The load orienting device of claim 7, wherein the controller detects unwanted rotation of the load orientating device and operates the first and second propellers to counteract unwanted rotation of the load orienting device.

9. The load orienting device of claim 1, wherein the controller adjusts the rotational speed of at least one of the first and second propellers to adjust the rotational speed of the load orienting device about a vertical axis of the load orienting device.

10. The load orienting device of claim 1, further including first and second attachment devices, wherein the first attachment device allows the load orienting device to be attached to a lifting device and the second attachment device allows the load orienting device to be attached to a load to be lifted.

11. The load orienting device of claim 1, further including a housing having attachment points to which a cable attached to a load to be lifted may be coupled, wherein the first and second posts are moveably secured to the housing.

12. A method of operating a load orienting device, wherein the load orienting device includes a frame, first and second posts that are moveable and disposed on the frame, and first and second propellers disposed on the first and second posts, respectively , comprising the steps of:

moving the first and second posts to adjust a distance between the first and second propellers; and receiving a command to rotate the load orienting device in a first direction;

in response to the receiving step determining a direction in which the load orienting device is rotating;

in response to determining step, increasing a rotation speed of the first and second propellers if the load orienting device is rotating in the first direction and decreasing the rotation speed of the first and second propellers otherwise.

13. The method of claim 12, wherein third and fourth propellers are disposed on the first and second posts, respectively, and simultaneously operating the first and second propellers to generate airflow parallel to the first direction and operating the third and fourth propellers to generate airflow parallel to a second direction, wherein the first direction is opposite the second direction.

14. The method of claim 12, wherein the command comprises a first command and further including receiving a second command to adjust an orientation of the load orienting device and adjusting the orientation of the load orienting device in response to the second command.

15. The method of claim 12, wherein the command specifies a particular angle and further including determining a direction the load orienting device is pointing and operating the first and second propellers to change the direction the load orienting device is pointing by the particular angle.

16. The method of claim 12, wherein the command comprises a first command and further including receiving a second command to store a first orientation, receiving a third command to store a second orientation, and a fourth command to orient the load orienting device to a selected one of the first and second orientations.

17. The method of claim 12, further including maintaining an orientation of the load orienting device by operating the first and second propellers.

18. The method of claim 17, wherein maintaining the orientation of the load orienting device includes detecting unwanted rotation of the load orientating device and operating the first and second propellers to counteract the unwanted rotation of the load orienting device.

19. The method of claim 12, further including adjusting the rotational speed of the load orienting device about a vertical axis of the load orienting device by adjusting the rotational speed of at least one of the first and second propellers.

20. The method of claim 12, further including attaching the load orienting device to a lifting device and further attaching the load orienting device to a load to be lifted.

* * * * *